US012697698B2

(12) United States Patent
Lee et al.

(10) Patent No.: US 12,697,698 B2
(45) Date of Patent: Aug. 4, 2026

(54) RECYCLED POLISHING PAD AND PREPARATION METHOD THEREOF

(71) Applicant: Enpulse Co., Ltd., Chungcheongnam-do (KR)

(72) Inventors: Jungnam Lee, Chungcheongnam-do (KR); Seungsik Yoon, Chungcheongnam-do (KR); Jaechul Chang, Chungcheongnam-do (KR); Jaejung Byun, Chungcheongnam-do (KR); Yongsoo Choi, Chungcheongnam-do (KR); Yujin Shin, Chungcheongnam-do (KR); Jongwoo Kim, Chungcheongnam-do (KR); Sunghyung Oh, Chungcheongnam-do (KR)

(73) Assignee: Enpulse Co., Ltd., Chungcheongnam-do (KR)

( * ) Notice: Subject to any disclaimer, the term of this patent is extended or adjusted under 35 U.S.C. 154(b) by 0 days.

(21) Appl. No.: 19/274,644

(22) Filed: Jul. 21, 2025

(65) Prior Publication Data

US 2026/0061547 A1 Mar. 5, 2026

(30) Foreign Application Priority Data

Sep. 3, 2024 (KR) ..... 10-2024-0119211

(51) Int. Cl.
*B24B 37/24* (2012.01)
*B24B 37/22* (2012.01)
*B24B 37/26* (2012.01)

(52) U.S. Cl.
CPC ..... *B24B 37/24* (2013.01); *B24B 37/22* (2013.01); *B24B 37/26* (2013.01)

(58) Field of Classification Search
CPC ..... B24B 37/20; B24B 37/22; B24B 37/24; B24D 3/20; B24D 3/22; B24D 3/26; B24D 3/28; B24D 3/32; B24D 18/0045
See application file for complete search history.

(56) References Cited

U.S. PATENT DOCUMENTS 6,239,188 B1 5/2001 Kihara et al.
2002/0052166 A1* 5/2002 Kojima ..... B24B 49/16 451/5

(Continued)

FOREIGN PATENT DOCUMENTS

CN 101175603 A 5/2008
CN 105773400 A 7/2016

(Continued)

OTHER PUBLICATIONS

Office Action for Japanese Patent Application No. 2025-116167 issued by the Japanese Patent Office on Aug. 12, 2025.

(Continued)

*Primary Examiner* — Joel D Crandall
(74) *Attorney, Agent, or Firm* — IP & T GROUP LLP

(57) ABSTRACT

According to embodiments of the present invention, there are provided a recycled polishing pad and a process for preparing a recycled polishing pad. The recycled polishing pad comprises a cushion layer, an adhesive layer, and a reused polishing layer having a plurality of grooves on one side, and the compressibility of the reused polishing layer calculated by a specific equation is controlled within a predetermined range; thus, the polishing layer can be reused while excellent polishing rate and polishing uniformity are maintained.

13 Claims, 11 Drawing Sheets

(56) References Cited

U.S. PATENT DOCUMENTS

| | | | | |
|---|---|---|---|---|
| 2005/0098446 | A1* | 5/2005 | Tsai | B24B 37/046 205/672 |
| 2009/0075568 | A1* | 3/2009 | Kimura | B24D 3/32 51/293 |
| 2012/0009855 | A1* | 1/2012 | Allison | B32B 27/36 51/296 |
| 2022/0176514 | A1 | 6/2022 | Yun et al. | |
| 2023/0373055 | A1 | 11/2023 | Tateno et al. | |
| 2024/0308022 | A1 | 9/2024 | Ji et al. | |

FOREIGN PATENT DOCUMENTS

| | | | | | |
|---|---|---|---|---|---|
| CN | 115958525 | A | | 4/2023 | |
| CN | 117984229 | A | * | 5/2024 | B24B 49/00 |
| JP | 2014-054719 | A | | 3/2014 | |
| JP | 2022-058234 | A | | 4/2022 | |
| JP | 2022-090651 | A | | 6/2022 | |
| KR | 10-0418648 | B1 | | 2/2004 | |
| KR | 10-0857504 | B1 | | 9/2008 | |
| KR | 10-2020-0132246 | A | | 11/2020 | |
| KR | 20200132246 | A | * | 11/2020 | B24B 37/22 |
| KR | 10-2020-0139907 | A | | 12/2020 | |
| KR | 10-2623531 | B1 | | 1/2024 | |
| KR | 20240009690 | A | * | 1/2024 | B24B 37/22 |
| KR | 20240150061 | A | * | 10/2024 | B24D 18/0072 |
| KR | 20240164120 | A | * | 11/2024 | B32B 7/12 |

OTHER PUBLICATIONS

Office Action for Chinese Patent Application No. 202510879442.6 issued by the Chinese Patent Office on May 16, 2026.

* cited by examiner

RECYCLED POLISHING PAD AND PREPARATION METHOD THEREOF

CROSS REFERENCE TO RELATED APPLICATION

The present application claims priority under 35 U.S.C. § 119(a) to Korean patent application number 10-2024-0119211 filed on Sep. 3, 2024 in the Korean Intellectual Property Office, the entire disclosure of which is incorporated by reference herein.

TECHNICAL FIELD

The present invention relates to a recycled polishing pad and a process for preparing the same.

BACKGROUND ART

A chemical mechanical planarization (CMP) process may be carried out for various purposes in various technical fields. For example, a CMP process may be used to planarize the surfaces of materials and substrates used in semiconductor devices, electronic components, optical components, and the like, remove aggregated substances, resolve damage to crystal lattices, and remove surface defects and contaminants.

In a CMP process, a polishing pad may be used to polish the surface of an object to be polished. Since the polishing pad interacts directly with the surface of the object to be polished, it may have an impact on the processing quality of the object to be polished. For example, the polishing characteristics of a CMP process may significantly vary depending on the components contained in the polishing pad and the physical properties of the polishing pad.

As environmental problems such as climate change have arisen in recent years, public opinion is forming that companies should take social responsibility for building a society capable of sustainable development through ESG management such as "carbon neutrality." Polishing pads used in a CMP process are consumables and are discarded after use rather than reused, which may cause environmental pollution. Accordingly, attempts have been made to recycle polishing pads upon completion of their use.

Meanwhile, as a CMP process proceeds, the pad layer of the polishing pad may wear out, or the pad layer may become thinner. Conventionally, methods for recycling polishing pads have been studied by adding or supplementing a new pad layer to a polishing pad used to conduct desired CMP performance. However, in such a case, as additional new pad layers are required to reuse the polishing pads, the process may become more complex and costly. Further, additional environmental issues may arise during the production of such new pad layers.

Accordingly, there is a need to develop a technology that can increase the recyclability of a polishing pad while it has excellent physical properties that satisfy the performance required for a CMP process.

PRIOR ART DOCUMENT

Patent Document (Patent Document 1) Korean Patent No. 10-0418648

DETAILED DESCRIPTION OF THE INVENTION

Technical Problem

The technical problem to be solved by the present invention is to provide a recycled polishing pad capable of achieving a desired polishing rate and polishing uniformity and having excellent CMP performance as it comprises a reused polishing layer having a predetermined compressibility.

In addition, the present invention provides a process for preparing a recycled polishing pad by using a reused polishing layer having a predetermined compressibility from a polishing pad upon completion of its use.

Solution to the Problem

The polishing pad according to an embodiment of the present invention comprises a cushion layer; an adhesive layer formed on the cushion layer; and a reused polishing layer attached to the adhesive layer and comprising a groove on one side, wherein the compressibility of the reused polishing layer calculated by the following Equation 1 is 0.9% or more.

[Equation 1]

$$\text{Compressibility of the reused polishing layer (\%)} = \frac{T1 - T2}{T1} \times 100$$

In Equation 1, T1 is the thickness (mm) of the reused polishing layer measured when the reused polishing layer is pressed with a load of 85 g for 30 seconds, and T2 is the thickness (mm) of the reused polishing layer measured when the reused polishing layer is further pressed with a load of 885 g for 3 minutes after T1 is measured.

In the process for preparing a recycled polishing pad according to another embodiment of the present invention, a polishing layer is recovered from a polishing pad used in a CMP process, one side of the polishing layer is planarized, a groove is formed on one side of the planarized polishing layer to prepare a reused polishing layer, and a cushion layer is attached to the other side of the reused polishing layer using an adhesive. The compressibility of the reused polishing layer calculated by the above Equation 1 may be 0.9% or more.

Advantageous Effects of the Invention

According to an embodiment of the present invention, as the recycled polishing pad comprises a reused polishing layer having a specific range of compressibility, it can provide an enhanced polishing rate and polishing uniformity.

In addition, as the reused polishing layer has a compressibility within the above range and comprises a groove of a predetermined depth, the physical properties and polishing characteristics of the reused polishing pad can be maintained to be more excellent, and it can be suitably used in a polishing process.

According to another embodiment of the present invention, as a polishing layer having a specific range of compressibility is recovered from a polishing pad discarded after being used in a polishing process to prepare a reused polishing pad, an additional supplement pad is not required, thereby simplifying the recycling process and reducing the process cost.

BEST MODE FOR CARRYING OUT THE INVENTION

Hereinafter, the present invention will be described in detail with reference to various embodiments and examples. The embodiments are not limited to what has been disclosed below. The embodiments may be modified into various forms as long as the gist of the invention is not altered.

In this specification, terms referring to the respective components are used to distinguish them from each other and are not intended to limit the scope of the embodiment. In addition, in the present specification, a singular expression is interpreted to cover a plural number as well unless otherwise specified in the context.

Throughout the present specification, when a part is referred to as "comprising" an element, it is understood that other elements may be comprised, rather than other elements are excluded, unless specifically stated otherwise.

In the present specification, when one component is described to be formed on/under another component or connected or coupled to each other, it covers the cases where these components are directly or indirectly formed, connected, or coupled through another component. In addition, it should be understood that the criterion for the terms on and under of each component may vary depending on the direction in which the object is observed.

All numerical ranges related to the physical properties, dimensions, and the like of a component used herein are to be understood as being modified by the term "about," unless otherwise indicated.

In the numerical range that limits the size of components, physical properties, and the like described in the present specification, when a numerical range limited with the upper limit only and a numerical range limited with the lower limit only are separately exemplified, it should be understood that a numerical range combining these upper and lower limits is also encompassed in the exemplary scope.

Throughout the present specification, the terms first, second, and the like are used to describe various components. But the components should not be limited by the terms. The terms are used for the purpose of distinguishing one element from another.

Recycled Polishing Pad

Figure 1:
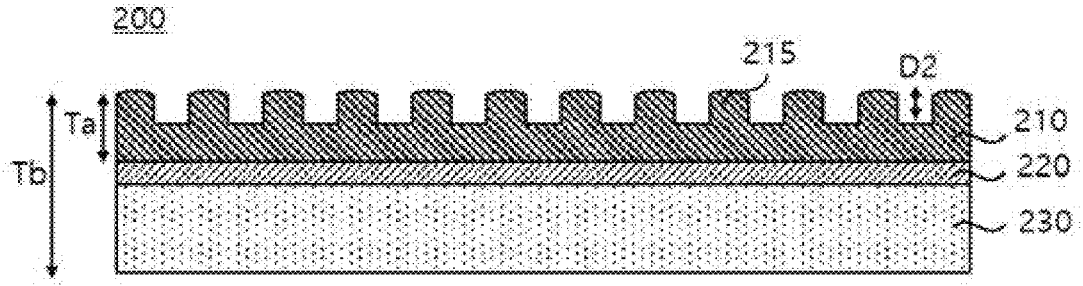
FIG. 1 is a schematic cross-sectional view showing a recycled polishing pad according to an embodiment of the present invention.

FIG. 1 is a schematic cross-sectional view showing a recycled polishing pad according to an embodiment of the present invention.

Referring to FIG. 1, the recycled polishing pad (200) may comprise a reused polishing layer (210), an adhesive layer (220), and a cushion layer (230). The reused polishing layer (210), the adhesive layer (220), and the cushion layer (230) may be sequentially laminated.

The reused polishing layer (210) may be derived from a polishing pad that has been discarded after being used in a polishing process. For example, the polishing layer contained in a waste polishing pad upon completion of its use may be recovered and used in the process for preparing a recycled polishing pad (200) described later.

A groove (215) may be formed on one side of the reused polishing layer (210). For example, the reused polishing layer (210) comprises a plurality of grooves (215) on the first side and may be attached to the cushion layer (230) through the second side opposite to the first side. The first side may be provided as a polishing surface that is brought into direct contact with an object to be polished during a polishing process. A large flow of a slurry on the polishing surface is controlled by the groove (215), and the object to be polished can be mechanically polished, thereby increasing the polishing efficiency.

The compressibility of the reused polishing layer (210) may be 0.9% or more. The compressibility of the reused polishing layer (210) may be calculated by the following Equation 1.

$$\text{Compressibility of the reused polishing layer (\%)} = \frac{T1 - T2}{T1} \times 100 \quad \text{[Equation 1]}$$

In Equation 1, T1 is the thickness (mm) of the reused polishing layer measured when the reused polishing layer is pressed with a load of 85 g for 30 seconds, and T2 is the thickness (mm) of the reused polishing layer measured when the reused polishing layer is further pressed with a load of 885 g for 3 minutes in the state of T1. The above compressibility may also be measured based on a specimen prepared by cutting the reused polishing layer into a size of 25 mm in width and length.

As the reused polishing layer (210) has a compressibility of 0.9% or more, even if the polishing layer recovered from a discarded polishing pad is reused, it is possible for the recycled polishing pad (200) to provide an enhanced polishing rate, polishing uniformity, and flatness. In addition, even if the reused polishing layer (210) has a relatively thinner thickness (Ta) than that of the polishing layer of a polishing pad that has not been used in a polishing process, excellent physical properties can be maintained, and the polishing speed can be enhanced while defects such as scratches that may be formed on the surface of an object to be polished are suppressed.

According to an embodiment, the compressibility of the reused polishing layer (210) may be 0.9% or more, 1.0% or more, 1.2% or more, 1.5% or more, 1.7% or more, or 1.8% or more, and may be 3.0% or less, 2.8% or less, 2.6% or less, 2.5% or less, 2.3% or less, 2.2% or less, 2.1% or less, or 2.0% or less.

Specifically, the compressibility of the reused polishing layer (210) may be 0.9% to 3.0%, more specifically, 0.9% to 2.8%, 0.9% to 2.6%, 0.9% to 2.1%, 1.0% to 2.1%, 1.2% to 2.1%, 1.5% to 2.0%, 1.7% to 2.0%, or 1.8% to 2.0%. Within the above range, the recycled polishing pad (200) can have further enhanced mechanical properties, durability, and stability, while polishing efficiency and flatness are further improved.

The ratio (D2/Ta) of the depth (D2) of the groove (215) to the thickness (Ta) of the reused polishing layer (210) may be 0.7 or less. The thickness (Ta) of the reused polishing layer (210) may be a straight-line distance between the first side and the second side of the reused polishing layer (210), and the depth (D2) of the groove (215) may refer to a recessed depth from the first side toward the second side. The thickness (Ta) of the reused polishing layer (210) and the depth (D2) of the groove (215) may be measured in the unit of mm.

As the groove (215) has a depth within a predetermined range relative to the thickness of the reused polishing layer (210), polishing efficiency and polishing uniformity can be further enhanced. In addition, debris formed on the polishing surface of the reused polishing layer (210) can be trapped by the groove (215) having a depth described above, thereby enhancing the flowability of a slurry.

The ratio (D2/Ta) of the depth (D2) of the groove (215) to the thickness (Ta) of the reused polishing layer (210) may be 0.10 or more, 0.15 or more, 0.20 or more, 0.25 or more, or 0.30 or more, and may be 0.70 or less, 0.65 or less, 0.50 or less, 0.45 or less, 0.40 or less, or 0.35 or less.

Specifically, the ratio (D2/Ta) may be 0.1 to 0.7, 0.1 to 0.65, 0.1 to 0.5, 0.2 to 0.5, 0.25 to 0.45, 0.30 to 0.45, 0.30 to 0.40, or 0.30 to 0.35. Within the above range, the polishing removal rate and polishing speed of the recycled polishing pad (200) can be further enhanced, and the occurrence of defects on the surface of an object to be polished can be further suppressed.

According to an embodiment of the present invention, even if the reused polishing layer (210) is obtained from a waste polishing pad and has a relatively thin thickness, the compressibility and groove depth satisfy the above ranges. Thus, the mechanical properties and stability of the recycled polishing pad (200) can be maintained to be excellent, and the polishing performance and flatness can be substantially enhanced as compared with the conventional polishing pads before being used in a polishing process.

The ratio (D2/Tb) of the depth (D2) of the groove (215) to the total thickness (Tb) of the recycled polishing pad (200) may be 0.2 or less. The total thickness (Tb) of the recycled polishing pad (200) and the depth (D2) of the groove (215) may be measured in the unit of mm. As a result, the within-wafer non-uniformity and polishing efficiency are improved, and the hardness and durability required for a polishing process can be secured.

Specifically, the ratio (D2/Tb) of the depth (D2) of the groove (215) to the total thickness (Tb) of the recycled polishing pad (200) may be 0.2 or less, 0.19 or less, 0.18 or less, 0.17 or less, 0.16 or less, or 0.15 or less, and may be 0.05 or more, 0.07 or more, 0.08 or more, 0.09 or more, 0.10 or more, or 0.12 or more.

In an embodiment, the ratio (D2/Tb) may be 0.05 to 0.2, 0.07 to 0.19, 0.09 to 0.18, 0.10 to 0.18, 0.10 to 0.17, 0.10 to 0.16, or 0.12 to 0.15. Within the above range, while the strength and durability of the recycled polishing pad (200) are secured, the polishing performance can be further enhanced.

The depth (D2) of the groove (215) may be 0.75 mm or less. For example, the depth of the groove (215) may be 0.10 mm or more, 0.15 mm or more, 0.20 mm or more, 0.25 mm or more, 0.30 mm or more, or 0.35 mm or more, and may be 0.75 mm or less, 0.70 mm or less, 0.65 mm or less, 0.60 mm or less, 0.55 mm or less, 0.50 mm or less, 0.48 mm or less, or 0.45 mm or less. As a result, the flow of a polishing slurry can be controlled within a desired range, and the supply and discharge of the polishing slurry can be made smooth, so that the polishing efficiency and uniformity can be further improved.

Specifically, the depth (D2) of the groove (215) may be 0.10 mm to 0.75 mm, 0.15 mm to 0.70 mm, 0.2 mm to 0.65 mm, 0.25 mm to 0.60 mm, 0.25 mm to 0.55 mm, 0.25 mm to 0.50 mm, 0.30 mm to 0.50 mm, 0.30 mm to 0.48 mm, or 0.35 mm to 0.45 mm.

The thickness (Ta) of the reused polishing layer (210) may be 0.5 mm or more, 0.7 mm or more, 0.8 mm or more, 0.9 mm or more, or 1.0 mm or more, and may be 2.0 mm or less, 1.8 mm or less, 1.6 mm or less, 1.5 mm or less, 1.3 mm or less, or 1.2 mm or less. Specifically, the thickness (Ta) of the reused polishing layer (210) may be 0.5 mm to 2.0 mm, 0.7 mm to 1.8 mm, 0.8 mm to 1.6 mm, 0.8 mm to 1.5 mm, 0.9 mm to 1.3 mm, 0.9 mm to 1.2 mm, or 1.0 mm to 1.2 mm. As a result, the mechanical properties of the reused polishing layer (210), such as hardness and tensile strength, can be readily controlled within a desired range, and the stability and durability of the recycled polishing pad (200) can be further enhanced.

The total thickness (Tb) of the recycled polishing pad (200) may be 1.5 mm or more, 1.7 mm or more, 1.8 mm or more, 1.9 mm or more, or 2.0 mm or more, and may be 6.0 mm or less, 5.0 mm or less, 4.5 mm or less, 4.0 mm or less, 3.5 mm or less, 3.0 mm or less, or 2.6 mm or less. Specifically, the total thickness of the recycled polishing pad (200) may be 1.5 mm to 6.0 mm, 1.7 mm to 5.0 mm, 1.8 mm to 4.5 mm, 1.9 mm to 4.0 mm, 2.0 mm to 3.5 mm, 2.0 mm to 3.0 mm, or 2.0 mm to 2.6 mm.

The hardness of the reused polishing layer (210) may be 40 shore D to 70 shore D, 45 Shore D to 65 Shore D, 45 Shore D to 60 Shore D, 50 shore D to 60 shore D, or 50 shore D to 55 shore D.

The density of the reused polishing layer (210) may be 0.710 $g/m^3$ to 0.770 $g/m^3$, 0.710 $g/m^3$ to 0.760 $g/m^3$, 0.720 $g/m^3$ to 0.750 $g/m^3$, 0.720 $g/m^3$ to 0.745 $g/m^3$, 0.725 $g/m^3$ to 0.745 $g/m^3$, or 0.730 $g/m^3$ to 0.740 $g/m^3$.

The tensile strength of the reused polishing layer (210) may be 5 $N/mm^2$ to 30 $N/mm^2$, 10 $N/mm^2$ to 25 $N/mm^2$, 15 $N/mm^2$ to 25 $N/mm^2$, or 18 $N/mm^2$ to 22 $N/mm^2$.

The reused polishing layer (210) may have a porous structure. For example, the reused polishing layer (210) may comprise a plurality of pores on the surface and inside. The pores support the fine flow of a polishing slurry, so that the supply or discharge of the polishing slurry can be appropriately controlled by the pores.

In some embodiments, the average diameter ($D_{50}$) of the plurality of pores may be 10 μm to 30 μm, 10 μm to 27 μm, 12 μm to 25 μm, 14 μm to 22 μm, or 16 μm to 20 μm. The surface condition of the polishing pad, the flowability of a polishing slurry, and the polishing efficiency may vary depending on the average diameter of the pores.

The average diameter ($D_{50}$) of the pores may be measured through a 3D CT-scan. For example, based on the unit area of a polishing pad (1 $cm^2$), it is possible to measure the pores inside the reused polishing layer by a 3D CT-scan, and the CT data analysis and visualization software called Volume Graphics may be used to calculate the diameter, area, volume, and number of the pores. For example, the volume of a pore with a diameter of r may be calculated as $4\pi r^3/3$. The average diameter ($D_{50}$) may be defined as the diameter of the pore at a volume fraction of 50% in a volume distribution obtained by accumulating the pores in order of increasing diameter.

The compressibility of the recycled polishing pad (200) may be 0.25% or more. The compressibility of the recycled polishing pad (200) may be calculated by the following Equation 2.

[Equation 2]

$$\text{Compressibility of the recycled polishing pad (\%)} = \frac{T3 - T4}{T3} \times 100$$

In Equation 2, T3 is the thickness (mm) of the recycled polishing pad measured when the recycled polishing pad is pressed with a load of 85 g for 30 seconds, and T4 is the thickness (mm) of the recycled polishing pad measured when the recycled polishing pad is further pressed with a load of 885 g for 3 minutes in the state of T3.

As the recycled polishing pad (200) has a compressibility of 0.25% or more, the within-wafer non-uniformity and polishing rate can be further enhanced, and the occurrence of scratches on an object to be polished can be suppressed, so that the polishing quality can be further improved.

In an embodiment, the compressibility of the recycled polishing pad (200) may be 0.25% or more, 0.5% or more, 0.9% or more, 1.0% or more, 1.2% or more, 1.5% or more, 1.7% or more, 1.8% or more, or 2.0% or more, and may be 4.0% or less, 3.8% or less, 3.5% or less, 3.0% or less, 2.8% or less, or 2.5% or less.

Specifically, the compressibility of the recycled polishing pad (200) may be 0.25% to 4.0%, 0.5% to 3.8%, 0.9% to 3.5%, 0.9% to 3.0%, or 1.0% to 3.0%, more specifically, 1.2% to 3.0%, 1.2% to 2.8%, 1.5% to 2.8%, 1.7% to 2.8%, 1.8% to 2.5%, or 2.0% to 2.5%. Within the above range, the stability and durability of the polishing pad, the polishing rate for an object to be polished, and the polishing quality can be further enhanced.

In some embodiments, the compressibility of the recycled polishing pad (200) may be greater than the compressibility of the reused polishing layer (210).

The hardness of the recycled polishing pad (200) may be 35 Shore D to 55 Shore D, 38 Shore D to 55 Shore D, 40 Shore D to 50 Shore D, or 40 Shore D to 45 Shore D. In an embodiment, the hardness of the recycled polishing pad (200) may be lower than the compressibility of the reused polishing layer (210).

The reused polishing layer (210) may be in direct contact with the adhesive layer (220). In an embodiment, the cushion layer (230), the adhesive layer (220), and the reused polishing layer (210) may be sequentially laminated while in contact with each other. For example, another additional pad layer, such as a sub-pad or a supplementary pad, may not be interposed between the reused polishing layer (210) and the cushion layer (230). The reused polishing layer (210) has a compressibility within the above range, and the depth of the groove (215) is adjusted to a predetermined range; thus, it can have excellent properties even without supplementing an additional pad layer. The recycled polishing pad (200) can provide an enhanced polishing rate and within-wafer non-uniformity. Accordingly, the cost of the recycling process can be reduced, while environmental problems caused by additionally adopted pad layers and yield reduction due to complex processes can be prevented. The polishing pad can be made lighter, thinner, and smaller.

The cushion layer (230) is positioned under the reused polishing layer (210) to stably support the reused polishing layer (210) while absorbing and dispersing the impact applied to the reused polishing layer (210). In an embodiment, a cushion layer (230) that has not been used in a polishing process may be used.

The cushion layer (230) may comprise a substrate layer such as nonwoven fabric, suede, or a porous pad. In an embodiment, the cushion layer (230) may be prepared by forming a surface coating layer from a coating composition comprising a fluorine-based resin or a silane-based resin on the substrate layer. It may also be prepared by impregnating the substrate layer with a resin comprising a fluorine-modified polyurethane resin or a silane-modified polyurethane resin.

The thickness of the cushion layer (230) may be, for example, 0.5 mm to 4.0 mm, 0.6 mm to 3.5 mm, 0.8 mm to 3.0 mm, or 1.0 mm to 2.0 mm. Within the above range, the recycled polishing pad (200) can be made lighter while the cushion layer (230) can support the reused polishing layer (210) more stably.

The thickness of the reused polishing layer (210) may be thinner than the thickness of the cushion layer (230). Even if a thin polishing layer from a worn polishing pad is recovered and reused, the cushion layer (230) has a relatively thicker thickness than the reused polishing layer (210), so that the reused polishing pad (200) can be stably supported, and its durability can be enhanced.

The density of the cushion layer (230) may be 0.20 $g/m^3$ to 0.50 $g/m^3$, 0.25 $g/m^3$ to 0.45 $g/m^3$, 0.30 $g/m^3$ to 0.40 $g/m^3$, or 0.30 $g/m^3$ to 0.37 $g/m^3$.

The Shore C hardness of the cushion layer (230) may be 50 Shore C to 85 Shore C, 55 Shore C to 80 Shore C, 60 Shore C to 78 Shore C, or 68 Shore C to 76 Shore C.

The adhesive layer (220) may serve to adhere the reused polishing layer (210) and the cushion layer (220) to each other. In addition, the adhesive layer (220) can suppress a polishing slurry from flowing out, or leaking from, the upper part of the reused polishing layer (210) to the cushion layer (220).

In an embodiment, the adhesive layer (220) may be formed using a hot melt adhesive composition. For example, the adhesive layer (220) may comprise a hot melt adhesive having a melting point of 90° C. to 130° C. or 110° C. to 130° C.

The hot melt adhesive composition may comprise a commonly known hot melt adhesive. In an embodiment, the hot melt adhesive may comprise a polyurethane resin, a polyester resin, an ethylene-vinyl acetate resin, a polyamide resin, and/or a polyolefin resin. They may be used alone or in combination of two or more.

The thickness of the adhesive layer (220) may be, for example, 3 μm to 250 μm, 5 μm to 200 μm, 5 μm to 150 μm, 10 μm to 100 μm, 20 μm to 50 μm or 23 μm to 40 μm. Within the above range, the bonding strength between the reused polishing layer (210) and the cushion layer (230) can be further enhanced, and the recycled polishing pad (200) can be made lighter.

Process for Preparing a Recycled Polishing Pad

FIGS. 2*a* to 2*e* are each schematic cross-sectional views showing a part of a polishing pad in each step of a process for preparing a recycled polishing pad according to an embodiment.

Figure 2A:
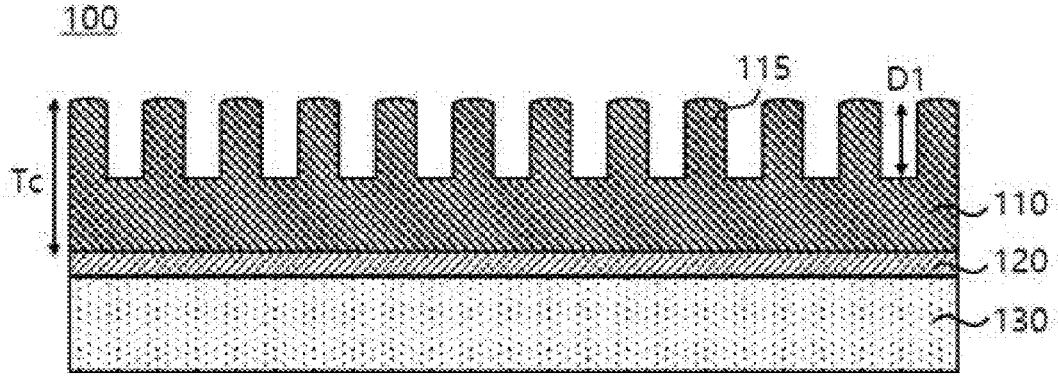
FIGS. 2*a* to 2*e* are each schematic cross-sectional views showing a part of a polishing pad in each step of a process for preparing a recycled polishing pad according to an embodiment.

FIG. 2*a* is a schematic cross-sectional view showing a polishing pad before being used in a polishing process.

Referring to FIG. 2*a*, the polishing pad (100) may comprise a polishing layer (110), an adhesive layer (120), and a cushion layer (130) sequentially laminated. The polishing layer (110) and the cushion layer (130) may be attached to each other through the adhesive layer (120).

The polishing layer (110) may comprise a polyurethane resin, a polyester resin, a polyamide resin, an acrylic resin, a polycarbonate resin, a halogen-based resin (polyvinyl chloride, polytetrafluoroethylene, polyvinylidene fluoride, and the like), a polystyrene resin, an olefin-based resin (polyethylene, polypropylene, and the like), an epoxy-based resin, or the like. Specifically, the polishing layer (110) may comprise a polyurethane resin.

The polishing layer (110) may have a porous structure. For example, the polishing layer (110) may be formed from a raw material mixture that comprises a urethane-based prepolymer, a curing agent, and a foaming agent. The urethane-based prepolymer may be a polymer prepared by reacting an isocyanate compound with a polyol.

A "prepolymer" generally refers to a polymer having a relatively low molecular weight wherein the degree of polymerization is adjusted to an intermediate level for the sake of conveniently molding a product in the process of producing the same. A prepolymer may be molded by itself or after a reaction with another polymerizable compound.

The foaming agent may comprise a solid phase foaming agent, a liquid phase foaming agent, or a gas phase foaming agent. Specifically, the foaming agent may comprise a solid phase foaming agent. The pores formed on the surface and inside of the polishing layer (110) may be derived from the foaming agent.

The curing agent may comprise an amine compound and/or an alcohol compound. For example, the curing agent may comprise at least one compound selected from the group consisting of an aromatic amine, an aliphatic amine, an aromatic alcohol, and an aliphatic alcohol.

A groove (115) may be formed on one side of the polishing layer (110). For example, the polishing layer (110) comprises a plurality of grooves (115) on the first side and may be attached to the cushion layer (130) through the second side opposite to the first side. The groove (115) may have a depth D1 of a predetermined depth or more. The depth D1 may be a depth that has a performance level that can be used in a polishing process. For example, if the groove (115) has too low a depth, the polishing rate required in a polishing process may not be achieved.

A polishing process can be performed on an object to be polished, such as a semiconductor substrate, using the polishing pad (100). The first side of the polishing layer (110) may be a polishing surface that is brought into direct contact with an object to be polished during a polishing process.

Figure 2B:
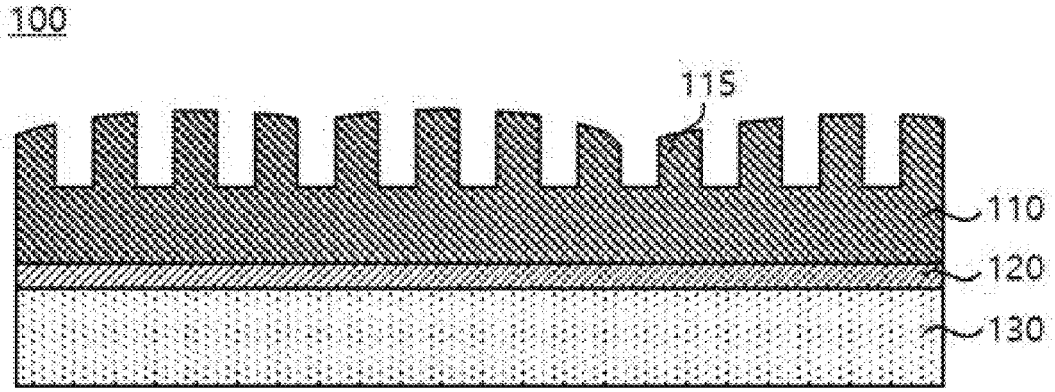

FIG. 2*b* is a schematic cross-sectional view showing a worn polishing pad after a polishing process has been performed.

Referring to FIG. 2*b*, as a polishing process, for example, a CMP process, is carried out, the polishing surface of the polishing layer (110) may gradually wear away. As the polishing surface wears, the thickness of the polishing layer (110) decreases, and the grooves (115) formed on the polishing surface may decrease in their depth or collapse. In addition, the wear rate of the polishing surface may differ by region depending on the polishing process conditions, the object to be polished, and the like. In such a case, the grooves (115) may have different depths, which may cause the polishing surface to become uneven.

When the depth of the grooves (115) is reduced or their shape is deformed to a depth or shape that makes it impossible to perform a polishing process any longer, the polishing pad (100) may be discarded.

The discarded polishing pad (100) may be recovered and cleaned. Impurities or foreign substances remaining on the polishing pad (100) after the polishing process may be removed by the cleaning. The cleaning process is not limited as long as it may be a method that can remove impurities by cleaning the discarded polishing pad (100). For example, wet cleaning, chemical cleaning, dry cleaning, mechanical cleaning, or the like may be used.

Figure 2C:
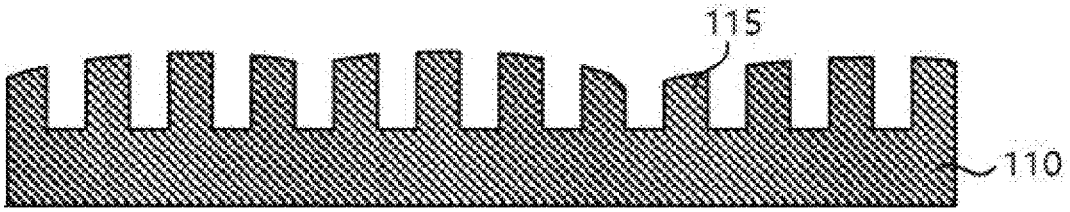

Referring to FIG. 2*c*, the adhesive layer (120) and cushion layer (130) may be removed from the discarded polishing pad (100) to selectively recover the polishing layer (110). For example, the process of recovering the polishing layer (110) may be carried outby a mechanical method of mechanically peeling or separating the adhesive layer (120) from the polishing layer (110), or by a chemical method of dissolving or decomposing and removing the adhesive layer (120).

Figure 2D:
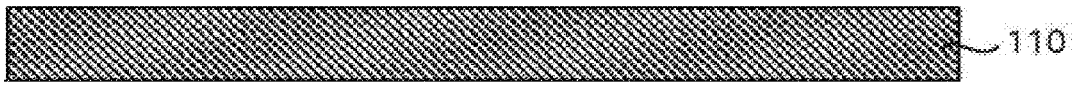

Referring to FIG. 2*d*, the polishing layer (110) may be planarized. For example, the first side of the polishing layer (110) on which the grooves (115) are formed may be planarized by cutting or milling. The grooves (115) formed on the first side of the polishing layer (110) may be removed by the planarizing process.

In an embodiment, a planarizing process may also be carried out on the second side of the polishing layer (110). The second side may be cut or milled to remove impurities such as adhesive components remaining on the second side.

The thickness of the polishing layer (110) may be reduced by the planarizing process of the polishing layer (110) to be adjusted to the thickness range of the reused polishing layer described above. For example, the thickness Tc of the initial polishing layer (110) may be reduced to a predetermined thickness through a polishing process, and it can be further reduced to the range of the thickness Ta described in FIG. 1 by the planarizing process.

For example, the planarizing process may be carried out such that the polishing layer (110) may have a thickness of 0.5 mm to 2.0 mm, 0.7 mm to 1.8 mm, 0.8 mm to 1.6 mm, 0.8 mm to 1.5 mm, 0.9 mm to 1.3 mm, 0.9 mm to 1.2 mm, or 1.0 mm to 1.2 mm.

Figure 2E:
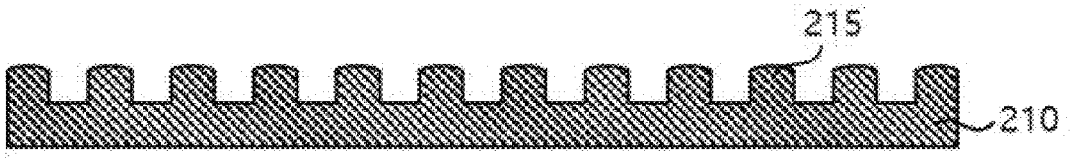

Referring to FIG. 2*e*, a groove is formed on one side of the planarized polishing layer (110) to prepare a reused polishing layer (210). For example, the reused polishing layer (210) may comprise a plurality of grooves (215) on the first side.

In an embodiment, the first side of the reused polishing layer (210) may be cut by a tip to form a groove (215). Specifically, the tip may be fixed such that it comes into contact with the first side, and a part of the first side may be removed by moving the reused polishing layer (210).

The cutting process by the tip may be carried out such that the depth of the grooves (215) satisfies the above range. For example, the cutting process may be carried out such that the grooves (215) have a depth of 0.10 or more, 0.15 or more, 0.20 or more, 0.25 or more, or 0.30 or more, and 0.70 or less, 0.65 or less, 0.50 or less, 0.45 or less, 0.40 or less, or 0.35 or less, relative to the thickness of the reused polishing layer (210).

For example, the depth of the grooves (215) formed by the cutting process may be 0.10 mm or more, 0.15 mm or more, 0.20 mm or more, 0.25 mm or more, 0.30 mm or more, or 0.35 mm or more, and may be 0.75 mm or less, 0.70 mm or less, 0.65 mm or less, 0.60 mm or less, 0.55 mm or less, 0.50 mm or less, 0.48 mm or less, or 0.45 mm or less, specifically, 0.10 mm to 0.75 mm, 0.15 mm to 0.70 mm, 0.2 mm to 0.65 mm, 0.25 mm to 0.60 mm, 0.25 mm to 0.55 mm, 0.25 mm to 0.50 mm, 0.30 mm to 0.50 mm, 0.30 mm to 0.48 mm, or 0.35 mm to 0.45 mm.

The grooves (215) may have a concentric circular shape spaced at a predetermined interval. In addition, a curved-surface processing process may be further carried out to process the edges of the grooves (215) into a curved surface. The curved-surface processing process may be carried out by using a grinder or a chock.

A cushion layer (230) may be laminated on the reused polishing layer (210) to prepare a recycled polishing pad (200). For example, an adhesive may be applied to the second side of the reused polishing layer (210) and/or one side of the cushion layer (230), the reused polishing layer (210) and the cushion layer (230) may be laminated such that the second side of the reused polishing layer (210) and the one side of the cushion layer (230) come into contact with each other, and the laminate may be pressed. As a result, as described in FIG. 1, a recycled polishing pad (200) having a structure in which a reused polishing layer (210), an adhesive layer (220), and a cushion layer (230) are sequentially laminated may be prepared.

According to an embodiment of the present invention, even if a polishing layer obtained from a waste polishing pad is reused, the reused polishing layer (210) has a compressibility of 0.9% or more, whereby the mechanical properties, such as hardness, durability, and pad cut rate, and the polishing performance, such as polishing rate and flatness, can be substantially equivalent to, or enhanced as compared with, an initial polishing pad (110) before being used in a polishing process.

In addition, when a reused polishing layer is prepared using only a polishing layer obtained from a waste polishing pad without using an additional supplementary pad, the thickness (Ta) of the reused polishing layer (210) becomes thinner than the thickness (Tc) of the initial polishing layer (110). According to an embodiment of the present invention, as the reused polishing layer (210) has a compressibility as described above, and as grooves (215) are formed to have a predetermined depth ratio relative to the thickness of the reused polishing layer (210), enhanced physical properties and polishing performance can be achieved.

In an embodiment, in the step of recovering a polishing layer (110) from a waste polishing pad (100), a polishing layer having a compressibility of 0.9% or more can be selected. The compressibility of the polishing layer may be calculated by the following Equation 3.

$$\text{Compressibility of the polishing layer (\%)} = \frac{T5 - T6}{T5} \times 100 \quad \text{[Equation 3]}$$

In Equation 3, T5 is the thickness (mm) of the polishing layer measured when the polishing layer is pressed with a load of 85 g for 30 seconds, and T6 is the thickness (mm) of the polishing layer measured when the polishing layer is further pressed with a load of 885 g for 3 minutes in the state of T5.

For example, as a polishing process progresses, the compressibility of a polishing layer changes from the initial value. Accordingly, the compressibility of the polishing layer adopted in a waste polishing pad may have a different value from the initial value. As a polishing layer having a compressibility of 0.9% or more is selectively recovered from a waste polishing pad, the polishing layer can be directly used in a reuse process without an additional processing step for adjusting the compressibility. Thus, process costs can be reduced, and recycled polishing pads having desired properties and polishing characteristics can be more readily obtained.

In an embodiment, the compressibility of the polishing layer (110) obtained from the waste polishing pad (100) may be substantially the same as the compressibility of the reused polishing layer. For example, it may be 0.9% to 3.0%, 0.9% to 2.8%, 0.9% to 2.6%, 0.9% to 2.2%, 0.9% to 2.1%, 1.0% to 2.1%, 1.2% to 2.1%, 1.5% to 2.0%, 1.7% to 2.0%, or 1.8% to 2.0%.

According to an embodiment of the present invention, as the recycled polishing pad comprises a reused polishing layer having a specific range of compressibility, the mechanical properties and polishing rate can be further enhanced while reusing a waste polishing pad. Since the surface defect characteristics appearing on the surface of a semiconductor substrate can be improved, high-quality semiconductor devices can be efficiently fabricated using the recycled polishing pad.

Hereinafter, the present invention is explained in detail by the following Examples. However, these examples are set forth to illustrate the present invention, and the scope of the present invention is not limited thereto.

EMBODIMENTS FOR CARRYING OUT THE INVENTION

Example 1

(1) Preparation of a Polishing Pad

A polishing pad was prepared using a casting device equipped with injection lines for a urethane-based prepolymer, a curing agent, an inert gas, and a reaction rate controlling agent.

Specifically, the prepolymer tank was charged with a urethane-based prepolymer (SKC) containing 9.3% by weight of unreacted NCO, the curing agent tank was charged with 4,4'-methylenebis(2-chloroaniline) (Ishihara), and nitrogen ($N_2$) was used as an inert gas. In addition, 1 part by weight of a solid phase foaming agent (AkzoNobel) and 1 part by weight of a silicone-based surfactant (Evonik) were mixed in advance relative to 100 parts by weight of the urethane-based prepolymer and then charged into the prepolymer tank.

The raw materials were stirred while they were fed to the mixing head at constant rates through the respective feeding lines. The molar equivalent ratio of the NCO group in the urethane-based prepolymer to the reactive groups in the curing agent was adjusted to 1:1, and the total feed rate was maintained at a rate of 10 kg/minute. The mixed raw materials were injected into a mold (1,000 mm×1,000 mm×3 mm) and solidified to obtain a molded article.

The top and bottom of the molded article were each cut by a thickness of 0.5 mm to obtain a polishing layer having a thickness of 2.03 mm. The compressibility of the polishing layer was measured to be 0.83%. Concentric grooves with a width of 0.45 mm and a depth of 0.85 mm were formed at equal intervals of 3.0 mm on one side of the polishing layer using a tip.

A cushion layer with a thickness of 1.3 mm was prepared in which a polyester fiber nonwoven fabric was impregnated with a polyurethane resin. The polishing layer and the cushion layer were combined using a hot melt adhesive to prepare a polishing pad (thickness: 3.43 mm) having a structure of a polishing layer, an adhesive layer, and a cushion layer.

(2) Preparation of a Waste Polishing Pad

The polishing pad was fixed to the platen of CMP equipment, and a silicon wafer (diameter: 300 mm) was set with the tungsten (W) film thereof facing downward. Then, a CMP process was carried out (polishing load: 2.8 psi with a calcined silica slurry applied). The CMP process was repeated until it was determined that the polishing pad could not be used any longer, and the polishing pad (waste polishing pad) upon completion of its use was collected.

(3) Preparation of a Recycled Polishing Pad

The cushion layer and adhesive layer were removed from the waste polishing pad, and a polishing layer having a compressibility of 1.89% was selected and recovered. The polishing layer was planarized to prepare a reused polishing layer with a thickness of 1.03 mm. Concentric grooves with a width of 0.45 mm and a depth of 0.35 mm were formed at equal intervals of 3.0 mm on one side of the reused polishing layer using a tip.

A recycled polishing pad comprising the reused polishing layer as a polishing layer was prepared. Specifically, a cushion layer with a thickness of 1.3 mm was prepared in which a polyester fiber nonwoven fabric was impregnated with a polyurethane resin. The reused polishing layer and the cushion layer were combined using a hot melt adhesive to prepare a recycled polishing pad (thickness: 2.43 mm) having a structure of a reused polishing layer, an adhesive layer, and a cushion layer.

Example 2

A recycled polishing pad (thickness: 2.43 mm) was prepared in the same manner as in Example 1, except that in step (3) of Example 1, a polishing layer having a compressibility of 1.0% was recovered from a waste polishing pad and planarized to prepare a reused polishing layer having a thickness of 1.03 mm.

Example 3

A recycled polishing pad (thickness: 2.43 mm) was prepared in the same manner as in Example 1, except that in step (3) of Example 1, a polishing layer having a compressibility of 2.2% was recovered from a waste polishing pad and planarized to prepare a reused polishing layer having a thickness of 1.03 mm.

Example 4

A recycled polishing pad (thickness: 2.43 mm) was prepared in the same manner as in Example 1, except that in step (3) of Example 1, concentric grooves with a width of 0.45 mm and a depth of 0.20 mm were formed at equal intervals of 3.0 mm on one side of the reused polishing layer.

Example 5

A recycled polishing pad (thickness: 2.43 mm) was prepared in the same manner as in Example 1, except that in step (3) of Example 1, concentric grooves with a width of 0.45 mm and a depth of 0.65 mm were formed at equal intervals of 3.0 mm on one side of the reused polishing layer.

Comparative Example 1

A polishing pad (thickness: 3.43 mm) was prepared in the same manner as in step (1) of Example 1.

Measurements of the Physical Properties of the Polishing Pad (1) Measurement of Compressibility The compressibility was measured for each of the polishing layer, reused polishing layer, and recycled polishing pad using a dial thickness gauge (129-E, YASUDA) in an environment of 23° C.±2° C. and 50%±5% humidity.

Specifically, a weight of 85 g was placed on each polishing layer (reused polishing layer) specimen having a size of 2.5 cm×2.5 cm in length and width for 30 seconds, and the thickness (T1 or T5) of the specimen was measured in the unit of mm. Thereafter, the weight was increased to 885 g, and the thickness of the specimen (T2 or T6) was measured in the unit of mm after 3 minutes. The compressibility of the polishing layer or the reused polishing layer was measured using the above Equation 1 or Equation 3.

In addition, under the same conditions, the thickness T3 (mm) and T4 (mm) of each polishing pad specimen having a size of 2.5 cm×2.5 cm in length and width were measured, and the compressibility of the polishing pad was measured using the above Equation 2.

(2) Measurement of Hardness

A polishing pad sample having a size of 2 cm×2 cm in length and width was allowed to stand for 16 hours under the conditions of a temperature of 25° C. and a humidity of 50±5%. Thereafter, the Shore D hardness of each polishing pad and each polishing layer was measured using a D-type hardness meter.

(3) Measurement of Density

The density of each polishing layer and each polishing pad was measured at 20° C. The density was measured by Archimedes's principle.

TABLE 1

| | | Ex. 1 | Ex. 2 | Ex. 3 | Ex. 4 | Ex. 5 | C. Ex. 1 |
|---|---|---|---|---|---|---|---|
| Groove | Depth (mm) | 0.35 | 0.35 | 0.35 | 0.20 | 0.65 | 0.85 |
| Polishing | Thickness (mm) | 1.03 | 1.03 | 1.03 | 1.03 | 1.03 | 2.03 |

TABLE 1-continued

| | | Ex. 1 | Ex. 2 | Ex. 3 | Ex. 4 | Ex. 5 | C. Ex. 1 |
|---|---|---|---|---|---|---|---|
| layer | Compressibility (%) | 1.89 | 1.0 | 2.2 | 1.89 | 1.89 | 0.83 |
| | Hardness (Shore D) | 53 | 53 | 53 | 53 | 53 | 54 |
| | Density (g/m$^3$) | 0.731 | 0.731 | 0.731 | 0.731 | 0.731 | 0.729 |
| | Groove depth/thickness | 0.34 | 0.34 | 0.34 | 0.194 | 0.631 | 0.419 |
| Polishing pad | Thickness (mm) | 2.43 | 2.43 | 2.43 | 2.43 | 2.43 | 3.43 |
| | Compressibility (%) | 2.1 | 1.2 | 2.6 | 2.1 | 2.1 | 1.1 |
| | Hardness (Shore D) | 41 | 41 | 41 | 41 | 41 | 52 |
| | Groove depth/thickness | 0.144 | 0.144 | 0.144 | 0.083 | 0.267 | 0.248 |

Test Example 1: Evaluation of Polishing Rate 1

Each polishing pad was fixed to the platen of CMP equipment, and a silicon wafer (diameter: 300 mm) was set with the silicon oxide layer thereof facing downward. Then, a CMP process was carried out. Specifically, the silicon oxide layer was polished under a polishing load as shown in Table 2 below while the platen was rotated at a speed of 150 rpm for 60 seconds and a silica slurry (ACESOL 2580) was supplied onto the polishing pad at a rate of 190 ml/minute. Upon completion of the polishing, the silicon wafer was detached from the carrier, mounted in a spin dryer, washed with deionized water, and then dried for 15 seconds. The thickness difference (polished thickness) of the silicon oxide layer before and after polishing at 98 locations on each dried silicon wafer was measured using a contact-type surface resistance measuring device (4-point probe). The average polished thickness was calculated from the measured values. The polishing rate (removal rate) was calculated using the following equation.

$$\text{Polishing rate (Å/minute)} = \text{average polished thickness of a silicon wafer (silicon oxide layer)(Å)/polishing time (minute)}$$

In Example 1 and Comparative Example 1, the region from the center of the silicon wafer to a radius of 60 mm was defined as the center region (Center), the region from a radius of 60 mm to a radius of 130 mm was defined as the middle region (Middle), and the region from a radius of 130 mm to a radius of 150 mm was defined as the edge region (Edge). The polishing rate in the center region was calculated as the average of the values (polished thickness) measured in the center region. The polishing rate in the middle region was calculated as the average of the values measured in the middle region. The polishing rate in the edge region was calculated as the average of the values measured in the edge region.

Figure 3A:
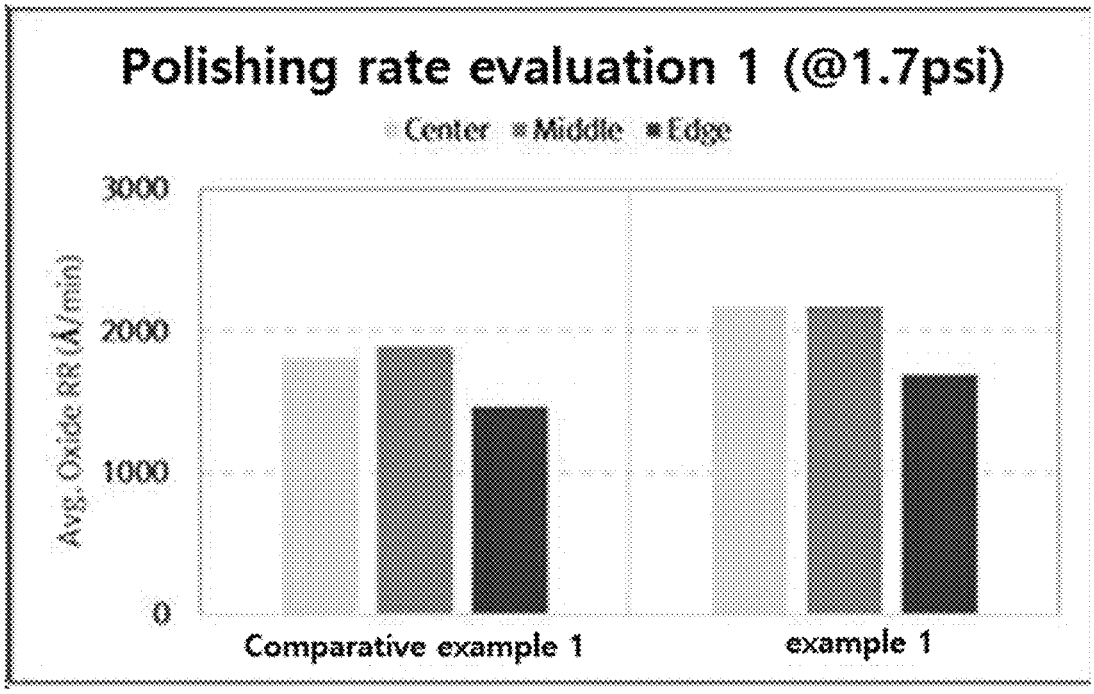
FIGS. 3*a* to 3*c* are each graphs showing the polishing rate in the center region (Center), the polishing rate in the middle region (Middle), and the polishing rate in the edge region (Edge) measured by Test Example 1.
Figure 3B:
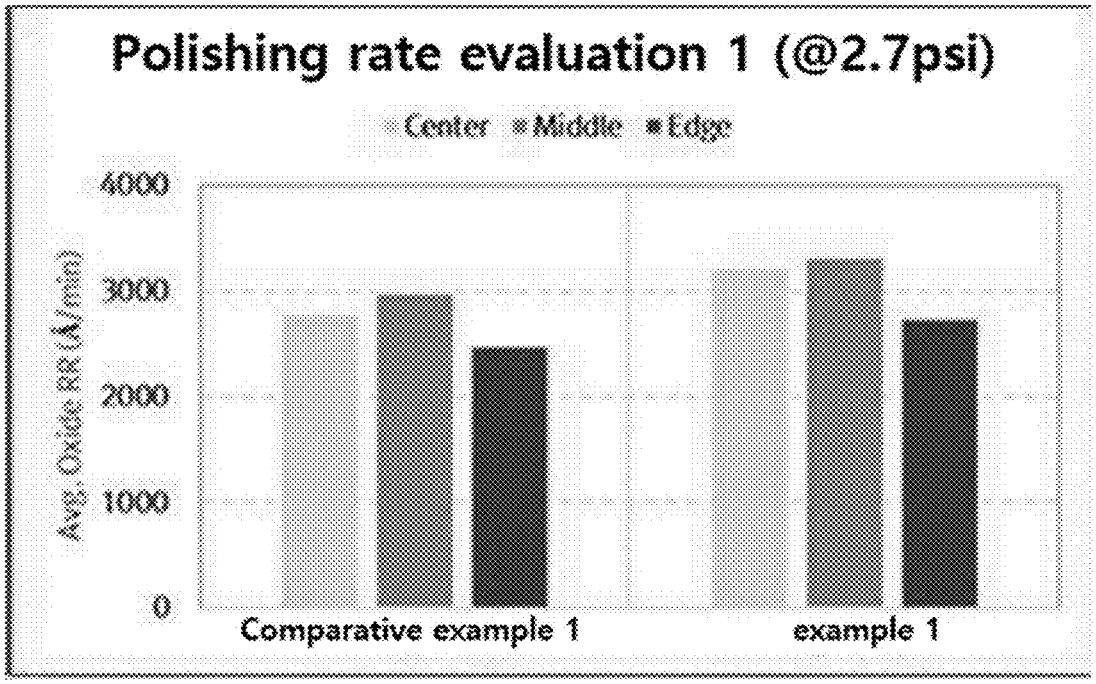
Figure 3C:
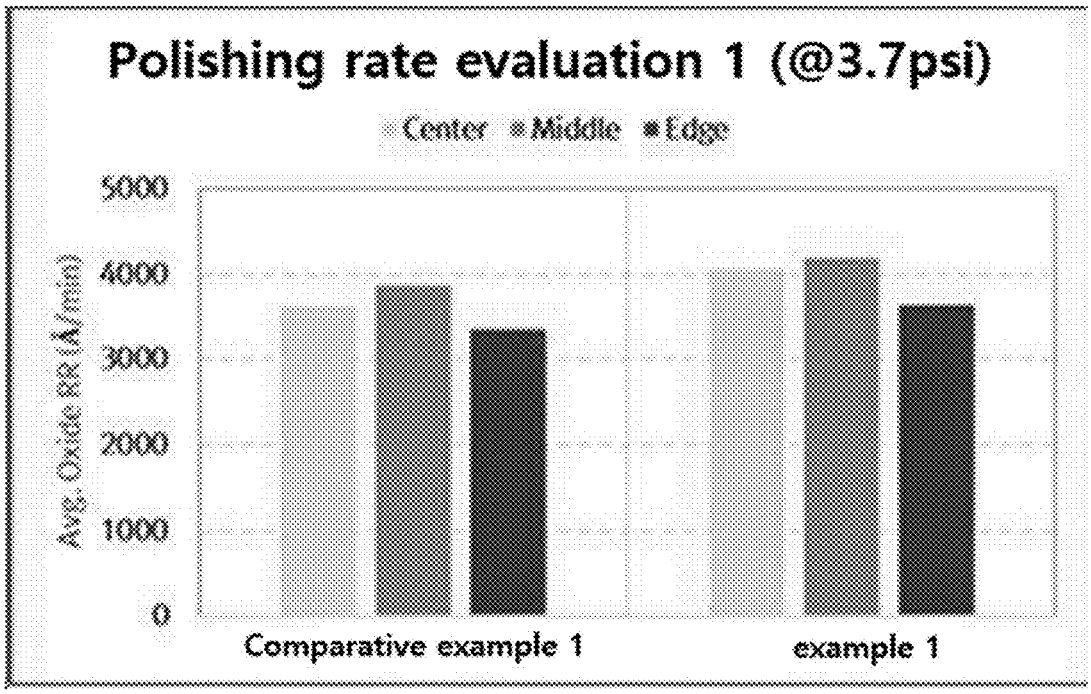

The center region (Center) polishing rate, middle region (Middle) polishing rate, and edge region (Edge) polishing rate are shown in FIGS. 3*a* to 3*c*. Specifically, FIG. 3*a* shows the polishing rate measured under a polishing load of 1.7 psi. FIG. 3*b* shows the polishing rate measured under a polishing load of 2.7 psi. FIG. 3*c* shows the polishing rate measured under a polishing load of 3.7 psi.

Figure 4A:
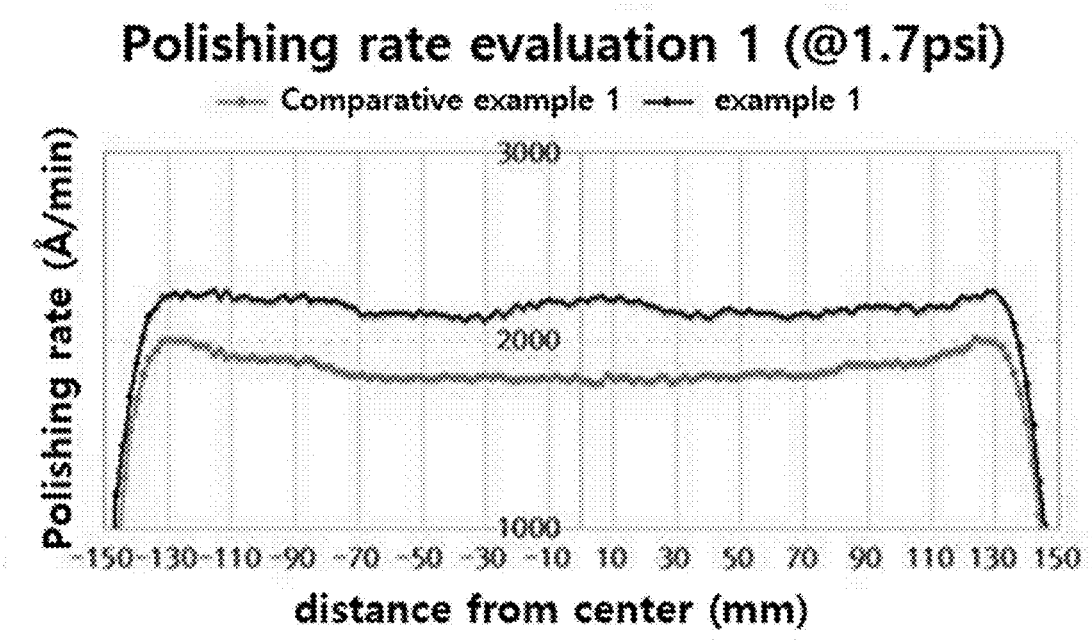
FIGS. 4*a* to 4*c* are each graphs showing the profile of the polishing rate with respect to the distance from the center measured by Test Example 1.
Figure 4B:
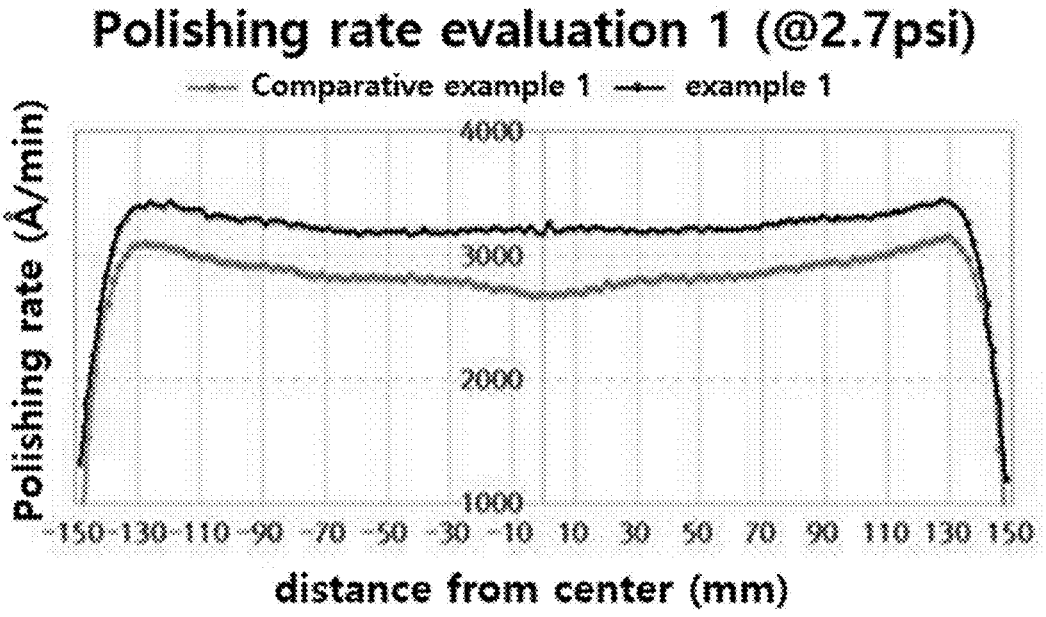
Figure 4C:
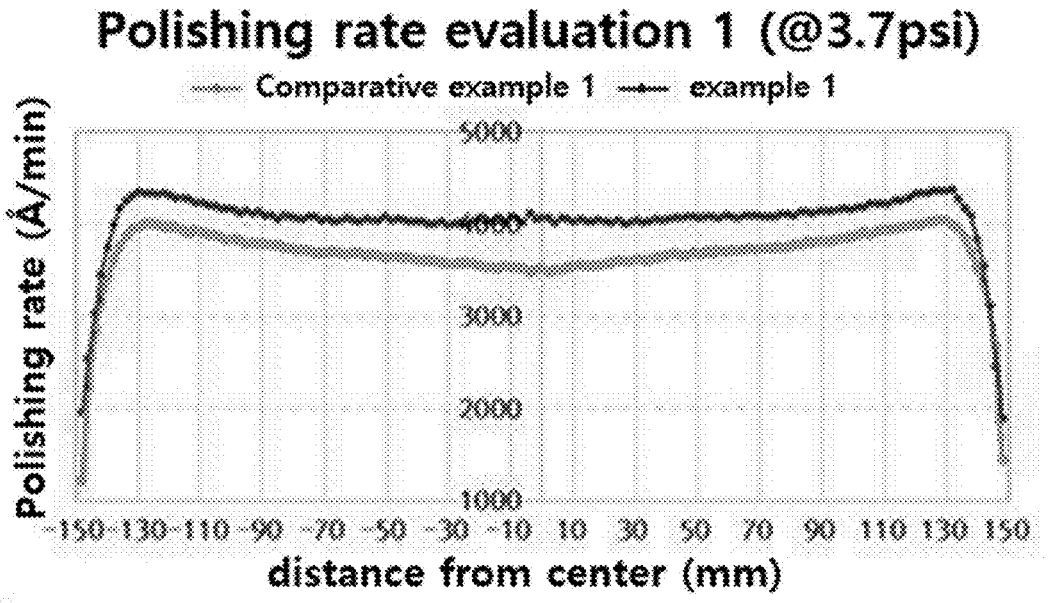

In addition, the profiles of the polishing rate with respect to the distance from the center are shown in FIGS. 4*a* to 4*c*.

Referring to FIGS. 3*a* to 3*c* and 4*a* to 4*c*, when a polishing process is carried out using the polishing pad of Example 1, a higher polishing rate was achieved than in Comparative Example 1 under all evaluated polishing loads. In addition, the polishing rate in Example 1 was measured to be more uniform over the entire region of the silicon wafer than in Comparative Example 1, indicating that the within-wafer non-uniformity was more excellent.

Test Example 2: Within-Wafer Non-Uniformity

The within-wafer non-uniformity (WIWNU) was calculated according to the following equation from the measurement values obtained in the evaluation of polishing rate 1 of Test Example 1.

$$\text{Within-wafer non-uniformity (\%)} = (\text{standard deviation of polished thickness (Å)}/\text{average polished thickness (Å)}) \times 100$$

Test Example 3: Evaluation of Polishing Rate 2

The polishing rate was evaluated in the same manner as in Test Example 1, except that the slurry was changed to a ceria slurry (ACS-580).

Figure 5A:
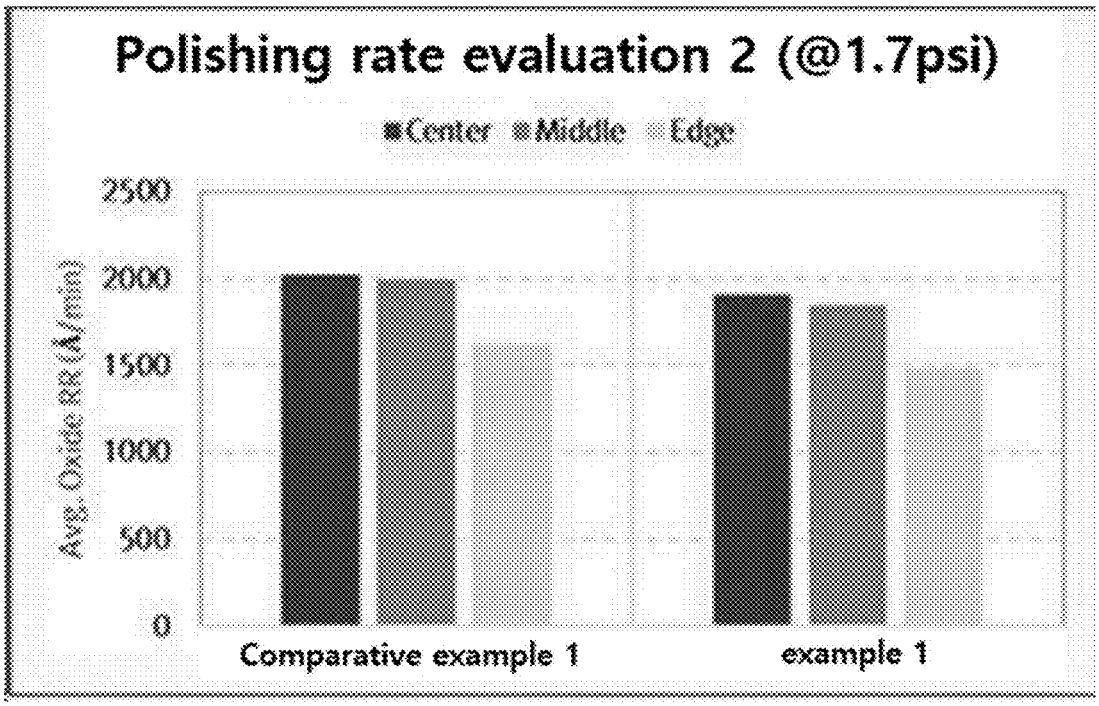
FIGS. 5*a* to 5*c* are each graphs showing the polishing rate in the center region, the polishing rate in the middle region, and the polishing rate in the edge region measured by Test Example 3.
Figure 5B:
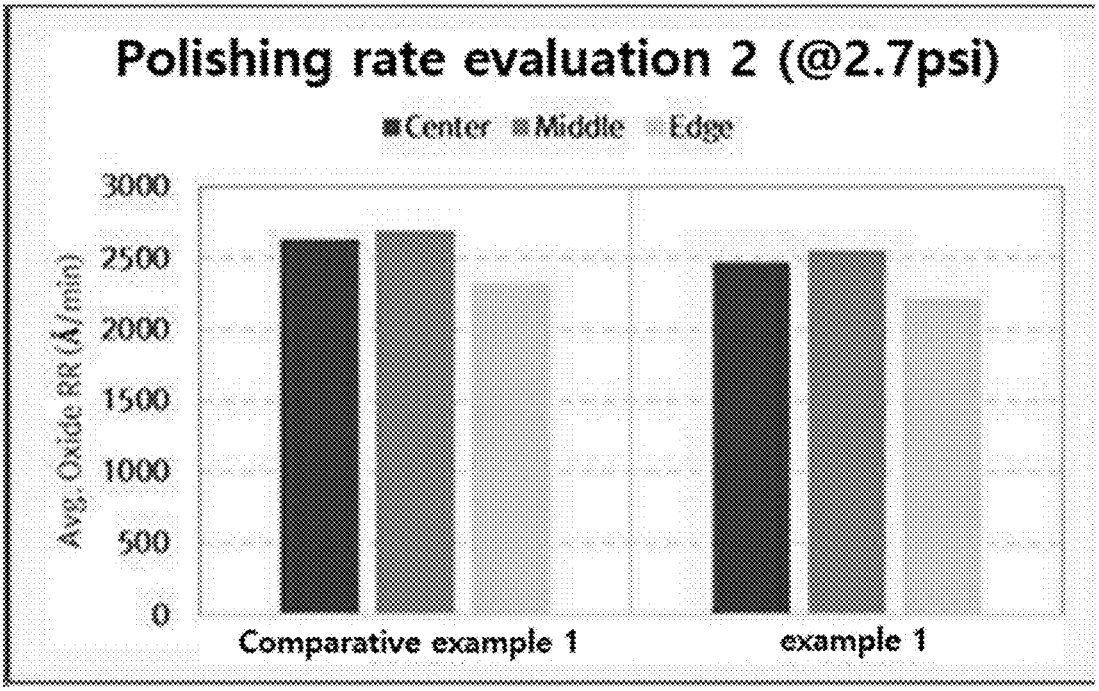
Figure 5C:
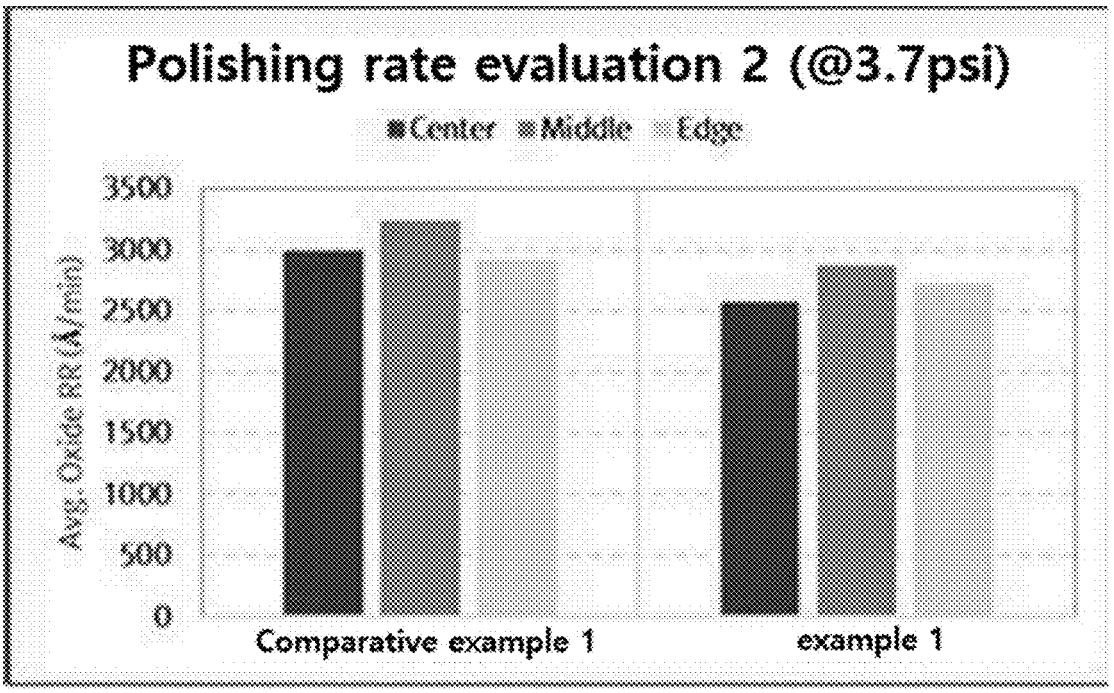

In Example 1 and Comparative Example 1, the polishing rates in the center region (Center), middle region (Middle), and edge region (Edge) of each silicon wafer are each measured and shown in FIGS. 5*a* to 5*c*. Specifically, FIG. 5*a* shows the polishing rate measured under a polishing load of 1.7 psi. FIG. 5*b* shows the polishing rate measured under a polishing load of 2.7 psi. FIG. 5*c* shows the polishing rate measured under a polishing load of 3.7 psi.

Referring to FIGS. 5*a* to 5*c*, the polishing pad of Example 1 had a polishing rate substantially similar to that of the polishing pad of Comparative Example 1, while indicating that the polishing uniformity was maintained to be excellent.

Test Example 4: Evaluation of Polishing Rate 3

The polishing rate was evaluated in the same manner as in Test Example 1, except that the object to be polished was changed to a tungsten (W) layer on a silicon wafer and that the slurry was changed to a silica slurry (SP6730). The difference in thickness of the tungsten layer before and after polishing was measured, and the polishing rate was calculated according to the following equation.

Polishing rate (Å/minute) = polished thickness of a silicon wafer (tungsten layer)(Å)/polishing time (minute)

Figure 6A:
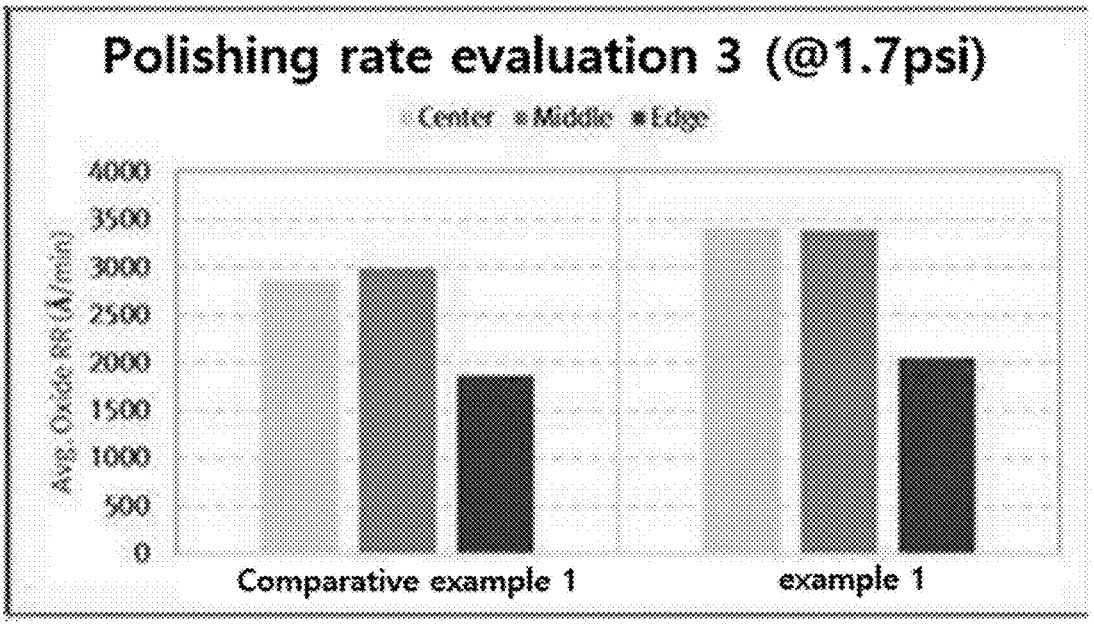
FIGS. 6*a* and 6*b* are each graphs showing the polishing rate in the center region (Center), the polishing rate in the middle region (Middle), and the polishing rate in the edge region (Edge) measured by Test Example 4.
Figure 6B:
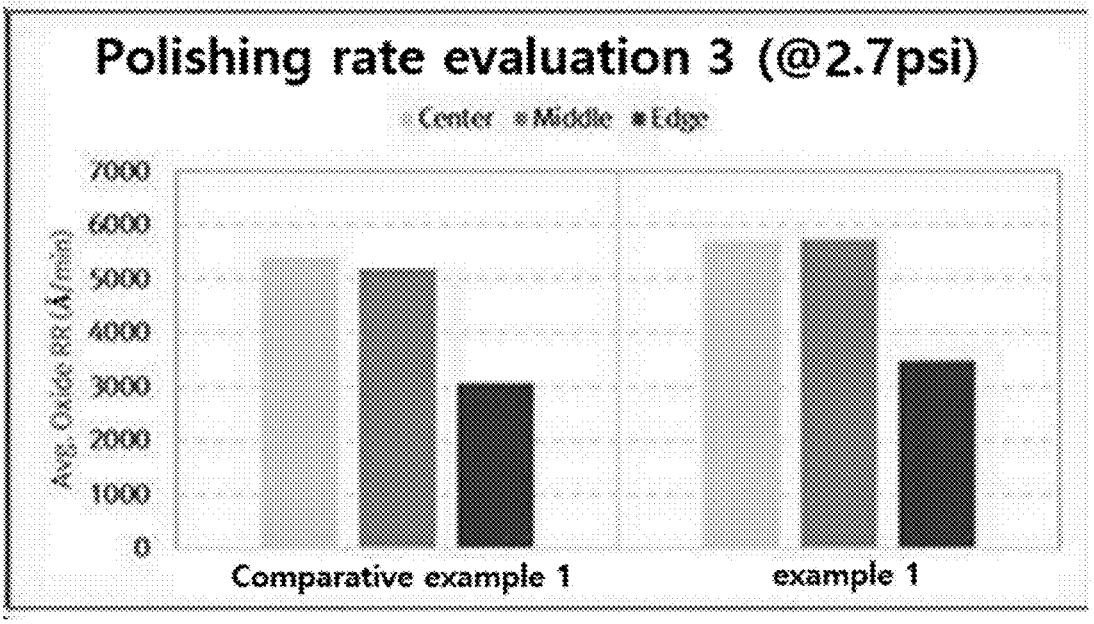

In Example 1 and Comparative Example 1, the polishing rates in the center region (Center), middle region (Middle), and edge region (Edge) of each silicon wafer are each measured and shown in FIGS. 6*a* and 6*b*. Specifically, FIG. 6*a* shows the polishing rate measured under a polishing load of 1.7 psi. FIG. 6*b* shows the polishing rate measured under a polishing load of 2.7 psi.

Figure 7A:
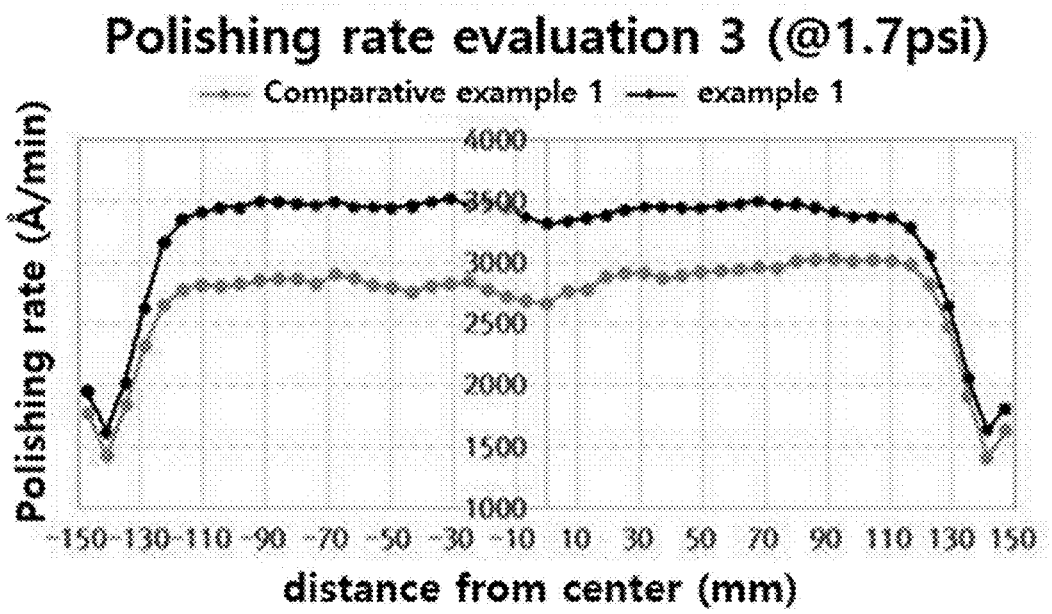
FIGS. 7*a* and 7*b* are each graphs showing the profile of the polishing rate with respect to the distance from the center measured by Test Example 4.
Figure 7B:
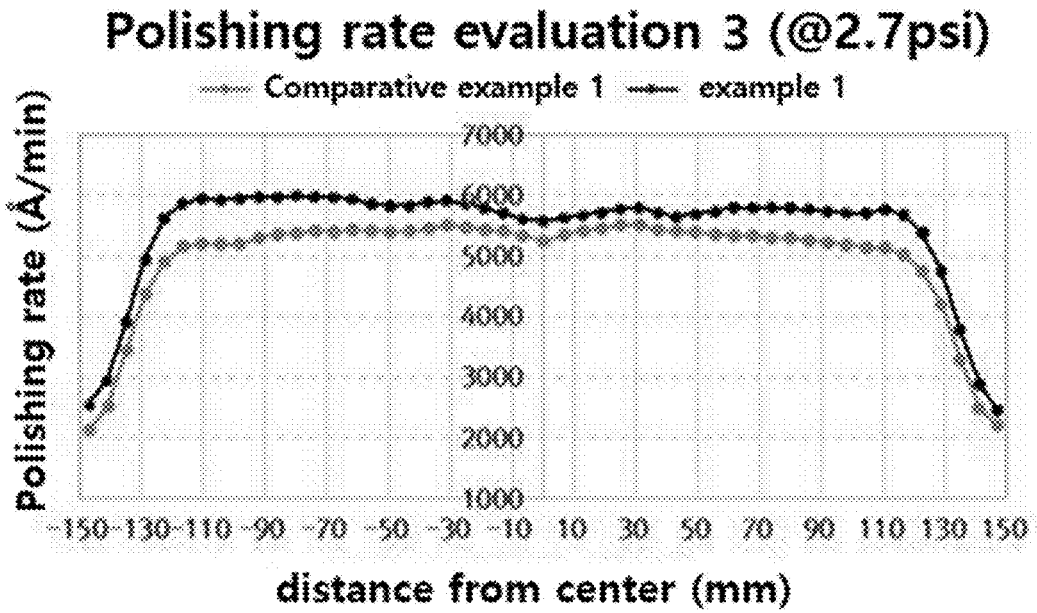

In addition, the profiles of the polishing rate with respect to the distance from the center are shown in FIGS. 7*a* and 7*b*.

Referring to FIGS. 6*a*, 6*b*, 7*a*, and 7*b*, Example 1 showed a higher polishing rate than that of Comparative Example 1, while indicating that the polishing rate was relatively uniform.

equipment. Thereafter, excluding the operation of the carrier, the debris of the polishing layer was collected using only the conditioner and deionized water (DIW). Conditioning of the polishing layer was carried out while deionized water was supplied at 300 cc/minute under the conditions of a platen speed of 93 rpm, a conditioner load of 9 lbs., a rotation speed of 64 rpm, and a sweep speed of 19 times/minute. Debris from the polishing layer along with deionized water was collected during conditioning. The particle size distribution of the collected debris was measured using a particle size analyzer (Mastersize 3000, Malvern) and a medium-capacity automatic disperser (Hydro MV, Malvern). In the particle size distribution, when the debris is arranged in order of increasing particle size, D10, D50, and D90 of debris were measured through particle sizes at the points of 10%, 50%, and 90%, respectively. The analyzer was set with a polyurethane of 1.55 as the refractive index of a material to be analyzed, deionized water of 1.33 as the refractive index of a dispersant, and a stirring speed of 2,500 rpm.

The evaluation results are shown in Table 3 below.

TABLE 2

| | | Ex. 1 | | | C. Ex. 1 | | |
|---|---|---|---|---|---|---|---|
| Polishing load | | 1.7 psi | 2.7 psi | 3.7 psi | 1.7 psi | 2.7 psi | 3.7 psi |
| Evaluation of polishing rate 1 | Avg. polishing rate (Å/min.) | 2,179 | 3,316 | 4,171 | 1,865 | 2,940 | 3,830 |
| | Within-wafer non-uniformity (%) | 2.8 | 2.6 | 2.6 | 3.9 | 4.0 | 4.0 |
| Evaluation of polishing rate 2 | Avg. polishing rate (Å/min.) | 1,745 | 2,424 | 2,680 | 1,931 | 2,564 | 2,923 |
| Evaluation of polishing rate 3 | Avg. polishing rate (Å/min.) | 2,643 | 4,787 | — | 2,219 | 4,317 | — |

Referring to Table 2 above, when the polishing process was carried out using the polishing pad of Example 1, a higher polishing rate was achieved than in Comparative Example 1, and a lower within-wafer non-uniformity was achieved, indicating that both the polishing efficiency and uniformity were excellent.

Test Example 5: Surface Roughness of the Polishing Pad

The surface roughness of the polishing pads of Example 1 and Comparative Example 1 was measured using an optical surface roughness meter (Contour GT, Bruker). Specifically, the surface roughness was measured under the scan options of a measurement mode of VSI/VXI, an eyepiece magnification of 5×, an objective lens magnification of 1.5×, a scan speed of ×1, a back scan of 10 μm, a length of 80 μm, and a threshold value of 5%. The accumulated data with respect to the measured height per unit area was plotted to obtain an area material ratio curve of surface roughness. The S parameter, which is a parameter converted into depth (height) from the area material ratio curve, was derived. Specifically, the core roughness depth (Sa), reduced valley depth (Svk), and reduced peak height (Spk) were measured for each polishing pad.

The evaluation results are shown in Table 3 below.

Test Example 6: Debris Size

The polishing pads of Example 1 and Comparative Example 1 were each set on the platen of CMP polishing

Test Example 7: Pad Cut Rate of the Polishing Pad

The polishing pads of Example 1 and Comparative Example 1 were pre-conditioned by spraying deionized water thereto for 10 minutes. Thereafter, conditioning was carried out while spraying deionized water onto each polishing pad for 1 hour, and the change in thickness (μm/hr) of the polishing pad before and after conditioning was measured. Here, the equipment used for pre-conditioning and conditioning was CTS AP-300HM. The pressure was 6 lbf, the rotational speed was 100 rpm to 110 rpm, and the disk used was Sasol LPX-DS2.

The evaluation results are shown in Table 3 below.

TABLE 3

| | Surface roughness | | | Debris size | | | |
|---|---|---|---|---|---|---|---|
| | Sa (μm) | Spk (μm) | Svk (μm) | D10 (μm) | D50 (μm) | D90 (μm) | Pad cut rate (μm/hr) |
| Ex. 1 | 9.9 | 8.4 | 15.7 | 5.29 | 16.5 | 50.4 | 24.2 |
| C. Ex. 1 | 9.2 | 7.7 | 16.9 | 5.11 | 15.7 | 45.2 | 23.5 |

Referring to Table 3 above, the polishing pad of Example 1 had excellent properties overall even though it comprised a reused polishing layer. Specifically, the surface roughness, debris size, and polishing pad cut rate thereof were substantially similar to those of Comparative Example 1 having a fresh polishing layer.

Figure 8A:
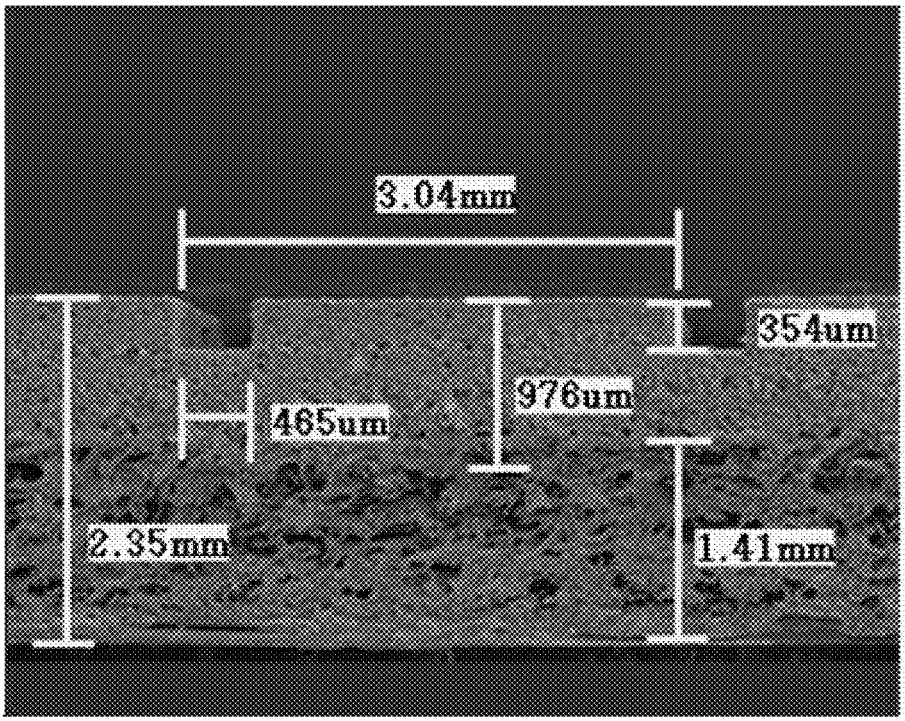
FIGS. 8*a* and 8*b* are each SEM images of cross-sections of some regions of the polishing pad of Example 1 taken at 5× magnification.
Figure 8B:
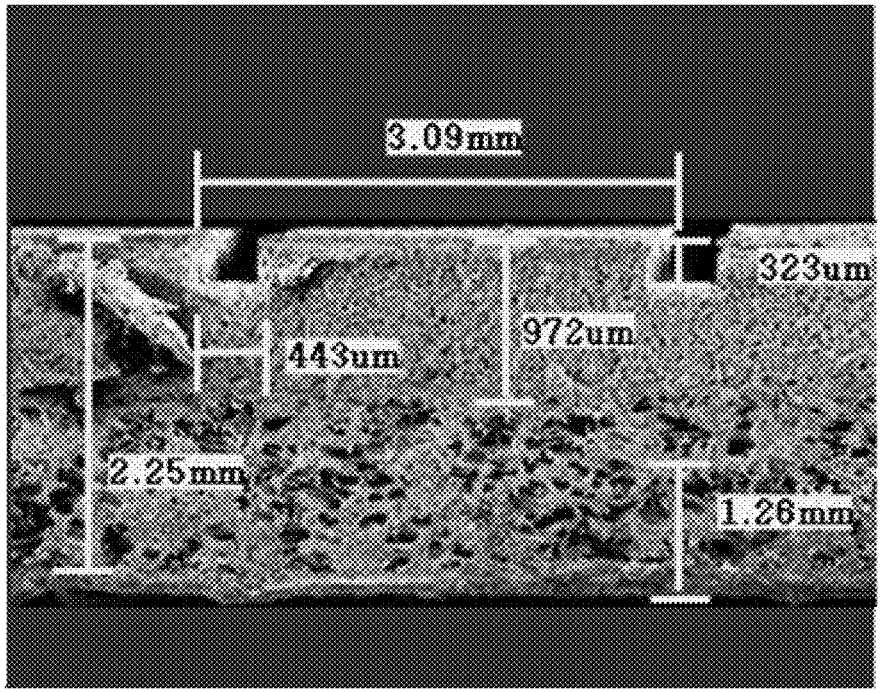
Figure 9A:
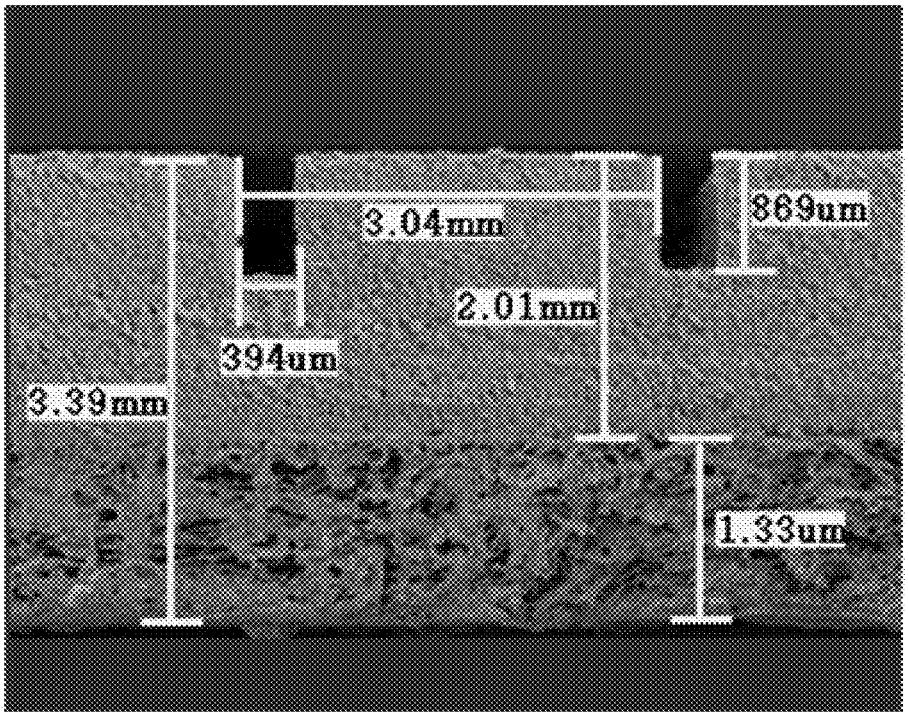
FIGS. 9*a* and 9*b* are each SEM images of cross-sections of some regions of the polishing pad of Comparative Example 1 taken at a 5× magnification.
Figure 9B:
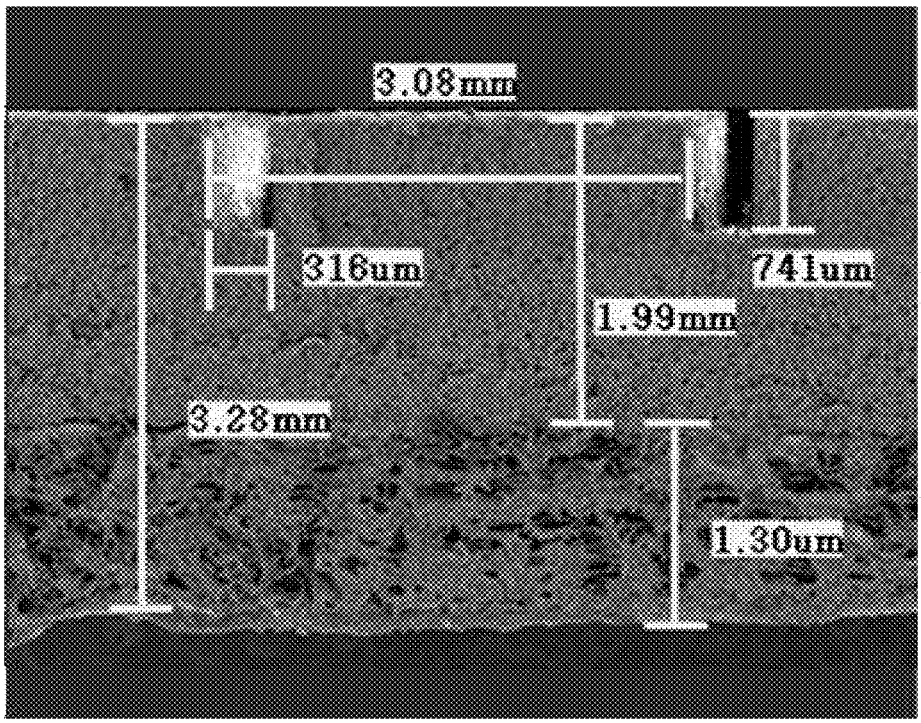

Test Example 8: Evaluation of the Cross-Section and Surface of the Polishing Pad The cross-section and surface of each of the polishing pads of Example 1 and Comparative Example 1 were observed by scanning electron microscopy (SEM). FIGS. 8*a* and 8*b* are each SEM images of some regions of the cross-section of the polishing pad of Example 1 taken at 5× magnification. FIGS. 9*a* and 9*b* are each SEM images of some regions of the cross-section of the polishing pad of Comparative Example 1 taken at a 5× magnification.

Specifically, FIGS. 8*a* and 9*a* are cross-sectional views of some regions of the polishing pad taken before the polishing rate evaluation. FIGS. 8*b* and 9*b* are cross-sectional views of some regions of the polishing pad taken after the polishing rate evaluation according to Test Example 1.

Referring to FIGS. 8*a* and 8*b*, in Example 1, the shape of the polishing pad was not substantially significantly changed even after the polishing rate evaluation, and the grooves and polishing layer had a shape, depth, and thickness that could be used again in a polishing process.

In contrast, referring to FIGS. 9*a* and 9*b*, in Comparative Example 1, the shape of the polishing pad was changed after the polishing rate evaluation, and it had a shape that is not suitable for use in a polishing process as the grooves were collapsed or the gaps were filled.

Figure 10A:
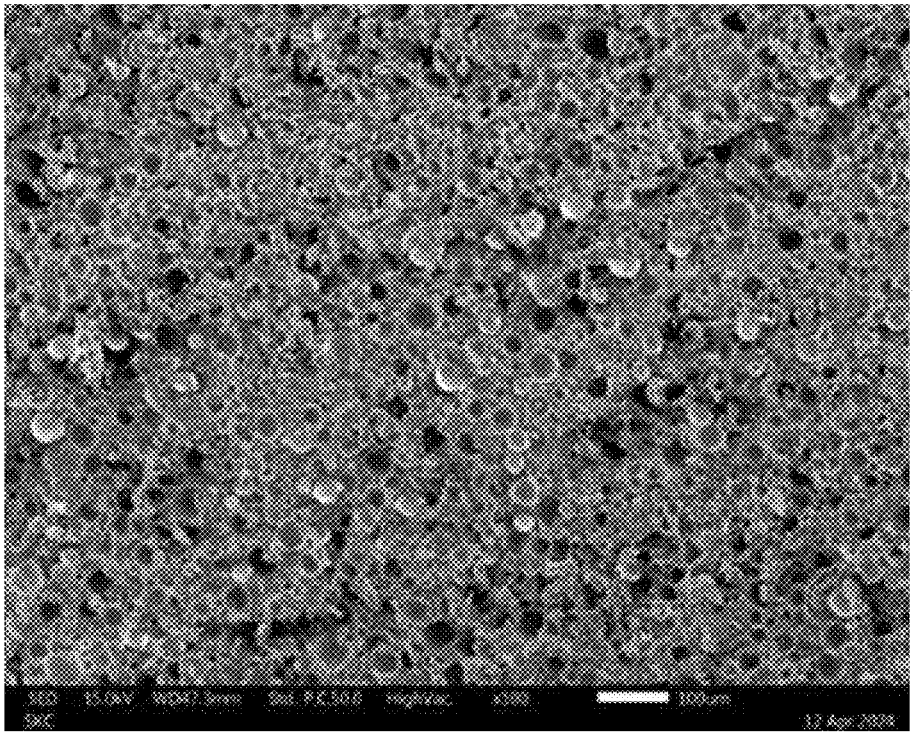
FIGS. 10*a* and 10*b* are each SEM images of cross-sections of some regions of the polishing layer of the polishing pad of Example 1 and Comparative Example 1 taken at 100× magnification.
Figure 10B:
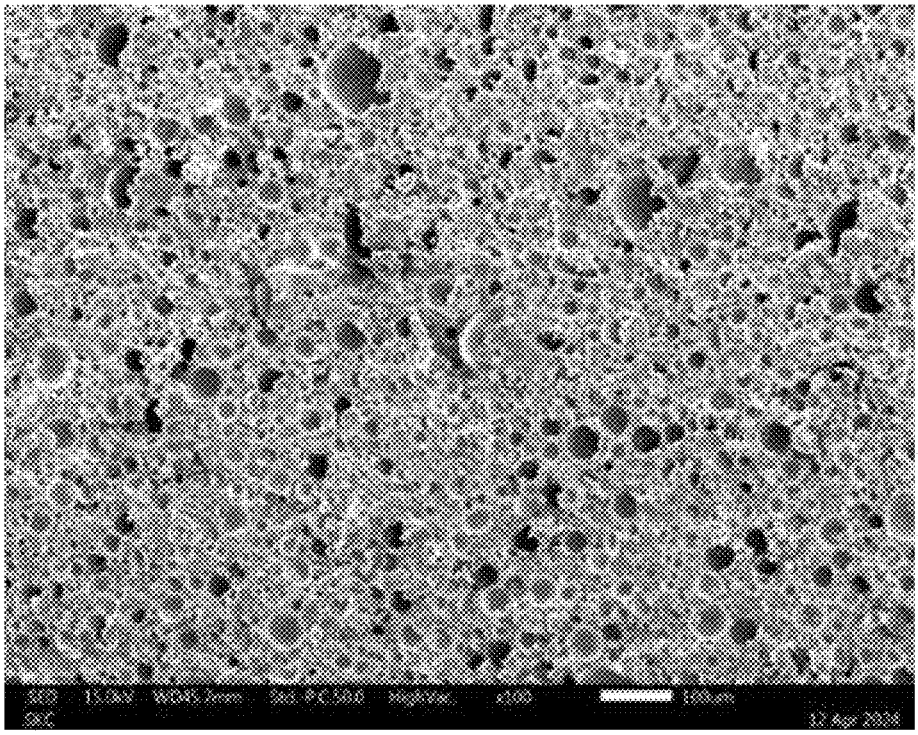

FIGS. 10*a* and 10*b* are each SEM images of cross-sections of some regions of the polishing layer of the polishing pad of Example 1 and Comparative Example 1 taken at 100× magnification.

Referring to FIG. 10*a*, the polishing layer of the polishing pad of Example 1 comprised pores and had a porosity substantially similar to that of the polishing layer of the initial polishing pad that was not used in the polishing process of Comparative Example 1.

Test Example 9: Evaluation of Polishing Rate with Respect to Compressibility and Groove Depth For the polishing pads of Examples 1 to 5 and Comparative Example 1, the polishing rate (Å/minute) for a silicon oxide layer was measured using the same method as in the evaluation of polishing rate 1 in Test Example 1 and the evaluation of polishing rate 2 in Test Example 3, respectively. The evaluation results are shown in Tables 4 and 5 below.

TABLE 4

| | Ex. 1 | Ex. 2 | Ex. 3 | C. Ex. 1 |
|---|---|---|---|---|
| Groove depth (mm) | 0.35 | 0.35 | 0.35 | 0.85 |
| Thickness of the polishing pad | 2.43 | 2.43 | 2.43 | 3.43 |
| Groove depth to the thickness of the polishing pad | 0.144 | 0.144 | 0.144 | 0.248 |
| Thickness of the polishing layer (mm) | 1.03 | 1.03 | 1.03 | 2.03 |
| Groove depth to the thickness of the polishing layer | 0.34 | 0.34 | 0.34 | 0.419 |
| Compressibility of the polishing layer (%) | 1.890 | 1.000 | 2.200 | 0.830 |
| Polishing rate (Å/min.) with a silica slurry | 3,043 | 2,835 | 3,231 | 2,761 |
| Polishing rate (Å/min.) with a ceria slurry | 2,235 | 2,307 | 2,449 | 2,232 |

TABLE 5

| | Ex. 1 | Ex. 4 | Ex. 5 | C. Ex. 1 |
|---|---|---|---|---|
| Groove depth (mm) | 0.35 | 0.2 | 0.65 | 0.85 |
| Thickness of the polishing pad | 2.43 | 2.43 | 2.43 | 3.43 |
| Groove depth to the thickness of the polishing pad | 0.144 | 0.082 | 0.267 | 0.248 |
| Thickness of the polishing layer (mm) | 1.03 | 1.03 | 1.03 | 2.03 |
| Groove depth to the thickness of the polishing layer | 0.340 | 0.194 | 0.631 | 0.419 |
| Compressibility of the polishing layer (%) | 1.89 | 1.89 | 1.89 | 0.83 |
| Polishing rate (Å/min.) with a silica slurry | 3,043 | 3,236 | 2,644 | 2,761 |
| Polishing rate (Å/min.) with a ceria slurry | 2,235 | 2,315 | 2,090 | 2,232 |

Referring to Table 4 above, the polishing rate varied depending on the compressibility of the polishing layer. Specifically, in Examples 1 to 3, the depth of the grooves, the thickness of the polishing layer, and the thickness of the polishing pad were substantially the same, whereas the polishing layers were different in the compressibility; as a result, the polishing rates of the wafer in the polishing process were different.

Referring to Table 5 above, the polishing rate of the wafer varied as the ratio of the groove depth to the thickness of the polishing layer changed. Specifically, in Examples 1 to 3, the compressibility of the polishing layer, the thickness of the polishing layer, and the thickness of the polishing pad were substantially the same, whereas the depths of the grooves relative to the thickness of the polishing layer were different since the grooves had different depths; as a result, the polishing rate of the wafer varied in the polishing process.

Accordingly, as the compressibility of the polishing layer and/or the depth of the grooves relative to the thickness of the polishing layer and the polishing pad are controlled, the polishing pad can have excellent physical properties, and the desired polishing characteristics can be provided in a polishing process.

REFERENCE NUMERAL OF THE DRAWINGS

100: polishing pad, 110: polishing layer, 115, 215: groove, 120, 220: adhesive layer, 130, 230: cushion layer, 200: recycled polishing pad, 210: reused polishing layer

What is claimed is:

1. A recycled polishing pad, which comprises a cushion layer; an adhesive layer formed on the cushion layer; and a reused polishing layer attached to the adhesive layer and comprising a groove on one side, wherein the compressibility of the reused polishing layer calculated by Equation 1 is 0.9% or more, $$\text{Compressibility of the reused polishing layer (\%)} = \frac{T1 - T2}{T1} \times 100 \quad \text{[Equation 1]}$$

in Equation 1, T1 is the thickness (mm) of the reused polishing layer measured when the reused polishing layer is pressed with a load of 85 g for 30 seconds, and T2 is the thickness (mm) of the reused polishing layer measured when the reused polishing layer is further pressed with a load of 885 g for 3 minutes after T1 is measured, and wherein the recycled polishing pad has a structure in which the cushion layer, the adhesive layer, and the reused polishing layer are sequentially laminated while in contact with each other, and wherein the ratio of the depth of the groove to the thickness of the reused polishing layer is 0.1 to 0.7.

2. The recycled polishing pad of claim 1, wherein the ratio of the depth of the groove to the total thickness of the recycled polishing pad is 0.2 or less.

3. The recycled polishing pad of claim 1, wherein the depth of the groove is 0.10 mm to 0.75 mm.

4. The recycled polishing pad of claim 1, wherein the compressibility of the reused polishing layer is 0.9% to 3.0%.

5. The recycled polishing pad of claim 1, wherein the thickness of the reused polishing layer is thinner than the thickness of the cushion layer.

6. The recycled polishing pad of claim 1, wherein the compressibility of the recycled polishing pad calculated by Equation 2 is 0.25% or more, $$\text{Compressibility of the recycled polishing pad (\%)} = \frac{T3 - T4}{T3} \times 100 \quad \text{[Equation 2]}$$

in Equation 2, T3 is the thickness (mm) of the recycled polishing pad measured when the recycled polishing pad is pressed with a load of 85 g for 30 seconds, and T4 is the thickness (mm) of the recycled polishing pad measured when the recycled polishing pad is further pressed with a load of 885 g for 3 minutes after T3 is measured.

7. The recycled polishing pad of claim 1, wherein the reused polishing layer has a hardness of 40 Shore D to 70 Shore D.

8. The recycled polishing pad of claim 1, wherein the recycled polishing pad has a hardness of 35 Shore D to 55 Shore D.

9. The recycled polishing pad of claim 1, wherein another pad layer is not interposed between the reused polishing layer and the cushion layer.

10. A process for preparing a recycled polishing pad, which comprises:

recovering a polishing layer from a polishing pad used in a CMP process;

planarizing one side of the polishing layer;

forming a groove on one side of the planarized polishing layer to prepare a reused polishing layer; and attaching a cushion layer to the other side of the reused polishing layer using an adhesive, wherein the compressibility of the reused polishing layer calculated by Equation 1 is 0.9% or more, $$\text{Compressibility of the reused polishing layer (\%)} = \frac{T1 - T2}{T1} \times 100 \quad \text{[Equation 1]}$$

in Equation 1, T1 is the thickness (mm) of the reused polishing layer measured when the reused polishing layer is pressed with a load of 85 g for 30 seconds, and T2 is the thickness (mm) of the reused polishing layer measured when the reused polishing layer is further pressed with a load of 885 g for 3 minutes after T1 is measured, and wherein the recycled polishing pad has a structure in which the cushion layer, an adhesive layer, and the reused polishing layer are sequentially laminated while in contact with each other, and wherein the ratio of the depth of the groove to the thickness of the reused polishing layer is 0.1 to 0.7.

11. The process for preparing a recycled polishing pad according to claim 10, wherein in the step of planarizing one side of the polishing layer, the groove of the polishing layer is removed.

12. The process for preparing a recycled polishing pad according to claim 10, wherein in the step of forming the groove, the groove is formed such that it has a depth of 0.7 times or less relative to the thickness of the reused polishing layer.

13. The process for preparing a recycled polishing pad according to claim 10, wherein the step of recovering a polishing layer comprises selecting a polishing layer having a compressibility of 0.9% or more as calculated by Equation 3 among polishing layers obtained from polishing pads used in the CMP process, $$\text{Compressibility of the polishing layer (\%)} = \frac{T5 - T6}{T5} \times 100 \quad \text{[Equation 3]}$$

in Equation 3, T5 is the thickness (mm) of the polishing layer measured when the polishing layer is pressed with a load of 85 g for 30 seconds, and T6 is the thickness (mm) of the polishing layer measured when the polishing layer is further pressed with a load of 885 g for 3 minutes after T5 is measured.

* * * * *